US010957978B2

(12) United States Patent
Cooper et al.

(10) Patent No.: US 10,957,978 B2
(45) Date of Patent: Mar. 23, 2021

(54) ELECTRONIC DEVICES HAVING MULTI-FREQUENCY ULTRA-WIDEBAND ANTENNAS

(71) Applicant: Apple Inc., Cupertino, CA (US)

(72) Inventors: Aaron J. Cooper, San Jose, CA (US); Amin Tayebi, San Jose, CA (US); Carlo Di Nallo, Belmont, CA (US); Vinh T. Le, San Jose, CA (US)

(73) Assignee: Apple Inc., Cupertino, CA (US)

( * ) Notice: Subject to any disclaimer, the term of this patent is extended or adjusted under 35 U.S.C. 154(b) by 41 days.

(21) Appl. No.: 16/456,856

(22) Filed: Jun. 28, 2019

(65) Prior Publication Data

US 2020/0411986 A1 Dec. 31, 2020

(51) Int. Cl.

| | |
|---|---|
| ***H01Q 1/24*** | (2006.01) |
| ***H01Q 5/25*** | (2015.01) |
| ***H01Q 1/38*** | (2006.01) |
| ***H01Q 1/48*** | (2006.01) |

(52) U.S. Cl.

CPC ..... *H01Q 5/25* (2015.01); *H01Q 1/243* (2013.01); *H01Q 1/38* (2013.01); *H01Q 1/48* (2013.01)

(58) Field of Classification Search

CPC ..... H01Q 5/25; H01Q 1/24; H01Q 1/243; H01Q 1/38; H01Q 1/48

See application file for complete search history.

(56) References Cited

U.S. PATENT DOCUMENTS

| | | | |
|---|---|---|---|
| 6,650,298 | B2 | 11/2003 | Abbasi et al. |
| 7,880,684 | B2 | 2/2011 | Schantz |
| 8,130,162 | B2 | 3/2012 | Kildal |
| 8,378,910 | B2 | 2/2013 | Wolf et al. |
| 8,610,635 | B2 * | 12/2013 | Huang ..... H01Q 15/0086 343/821 |
| 8,970,443 | B2 | 3/2015 | Ridgeway |
| 9,118,109 | B2 | 8/2015 | Oh et al. |
| 9,979,086 | B2 | 5/2018 | Ng et al. |
| 10,033,114 | B2 | 7/2018 | Anguera Pros et al. |
| 10,084,240 | B2 | 9/2018 | Shamblin et al. |

(Continued)

FOREIGN PATENT DOCUMENTS

WO 2019010051 A1 1/2019

OTHER PUBLICATIONS

Cooper et al. U.S. Appl. No. 16/035,325, filed Jul. 13, 2018.
Cooper et al. U.S. Appl. No. 16/277,808, filed Feb. 15, 2019.

*Primary Examiner* — Hoang V Nguyen
(74) *Attorney, Agent, or Firm* — Treyz Law Group, P.C.; Michael H. Lyons; Matthew R. Williams

(57) ABSTRACT

An electronic device may be provided with an antenna for receiving signals in first and second ultra-wideband communications bands. The antenna may include a first arm that radiates in the first band and a second arm that radiates in the second band. The antenna may be fed by a stripline. A microstrip may couple the stripline to the first and second arms and may be configured to match the impedance of the stripline to the impedance of the first and second arms in the first and second bands, respectively. Sets of antennas tuned to different frequencies may be fed by the same transmission line and may collectively exhibit a relatively wide bandwidth. A conductive shielding layer or other conductive components may be layered over the antennas to mitigate cross-polarization interference at the antennas.

16 Claims, 17 Drawing Sheets

(56) References Cited

U.S. PATENT DOCUMENTS

| | | | | |
|---|---|---|---|---|
| 2007/0262906 | A1 | 11/2007 | Haim et al. | |
| 2011/0050509 | A1 | 3/2011 | Ayala Vazquez et al. | |
| 2016/0204514 | A1* | 7/2016 | Miraftab | H01Q 21/005 343/737 |
| 2018/0145420 | A1 | 5/2018 | Kushta | |
| 2019/0097317 | A1 | 3/2019 | Di Nallo et al. | |

* cited by examiner

ELECTRONIC DEVICES HAVING MULTI-FREQUENCY ULTRA-WIDEBAND ANTENNAS

BACKGROUND

This relates to electronic devices and, more particularly, to electronic devices with wireless communications circuitry.

Electronic devices often include wireless communications circuitry. For example, cellular telephones, computers, and other devices often contain antennas and wireless transceivers for supporting wireless communications. Some electronic devices perform location detection operations to detect the location of an external device based on an angle of arrival of signals received from the external device (using multiple antennas).

To satisfy consumer demand for small form factor wireless devices, manufacturers are continually striving to implement wireless communications circuitry such as antenna components for performing location detection operations using compact structures. At the same time, there is a desire for wireless devices to cover a growing number of frequency bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over the desired range of operating frequencies.

It would therefore be desirable to be able to provide improved wireless communications circuitry for wireless electronic devices.

SUMMARY

An electronic device may be provided with wireless circuitry and control circuitry. The wireless circuitry may include antennas that are used to determine the position and orientation of the electronic device relative to external wireless equipment. The control circuitry may determine the position and orientation of the electronic device relative to the external wireless equipment at least in part by measuring the angle of arrival of radio-frequency signals from the external wireless equipment. The radio-frequency signals may be received in at least first and second ultra-wideband communications bands.

In one suitable arrangement, the antennas may include dual-band planar inverted-F antennas. Each antenna may include an antenna resonating element with a low band arm and a high band arm formed from conductive traces on a dielectric substrate. The high band arm may cover a first ultra-wideband communications band such as an 8.0 GHz ultra-wideband communications band. The low band arm may cover a second ultra-wideband communications band such as a 6.5 GHz ultra-wideband communications band.

The dielectric substrate may be a flexible printed circuit substrate formed from polyimide, liquid crystal polymer, or other materials. First and second radio-frequency transmission lines may be formed on the flexible printed circuit substrate. The first radio-frequency transmission line may be a stripline. The second radio-frequency transmission line may be a microstrip that couples the stripline to the low and high band arms. The microstrip may include signal trace segments that are configured to match an impedance of the stripline to the impedance of the low band arm in the 6.5 GHz ultra-wideband communications band while also matching an impedance of the stripline to the impedance of the high band arm in the 8.0 GHz ultra-wideband communications band.

If desired, the antennas may include first, second, third, and fourth planar inverted-F antennas coupled to the same radio-frequency transmission line. The first and second antennas may have response peaks at first and second frequencies in the 8.0 GHz ultra-wideband communications band. The third and fourth antennas may have response peaks at third and fourth frequencies in the 6.5 GHz ultra-wideband communications band. Signal traces may be configured to match an impedance of the radio-frequency transmission line to each of the first, second, third, and fourth antennas at the respective frequencies handled by each antenna.

If desired, the antennas may be aligned with openings in a conductive support plate. The antennas may radiate through a dielectric cover layer for the device. A conductive shielding layer and/or conductive components such as a battery may cover the antennas and the openings. The conductive shielding layer and the conductive component may mitigate cross-polarization interference associated gaps between the antennas and the conductive support plate. If desired, a plastic shim may be formed in the openings and the antennas may be mounted to the plastic shim.

DETAILED DESCRIPTION

Figure 1:
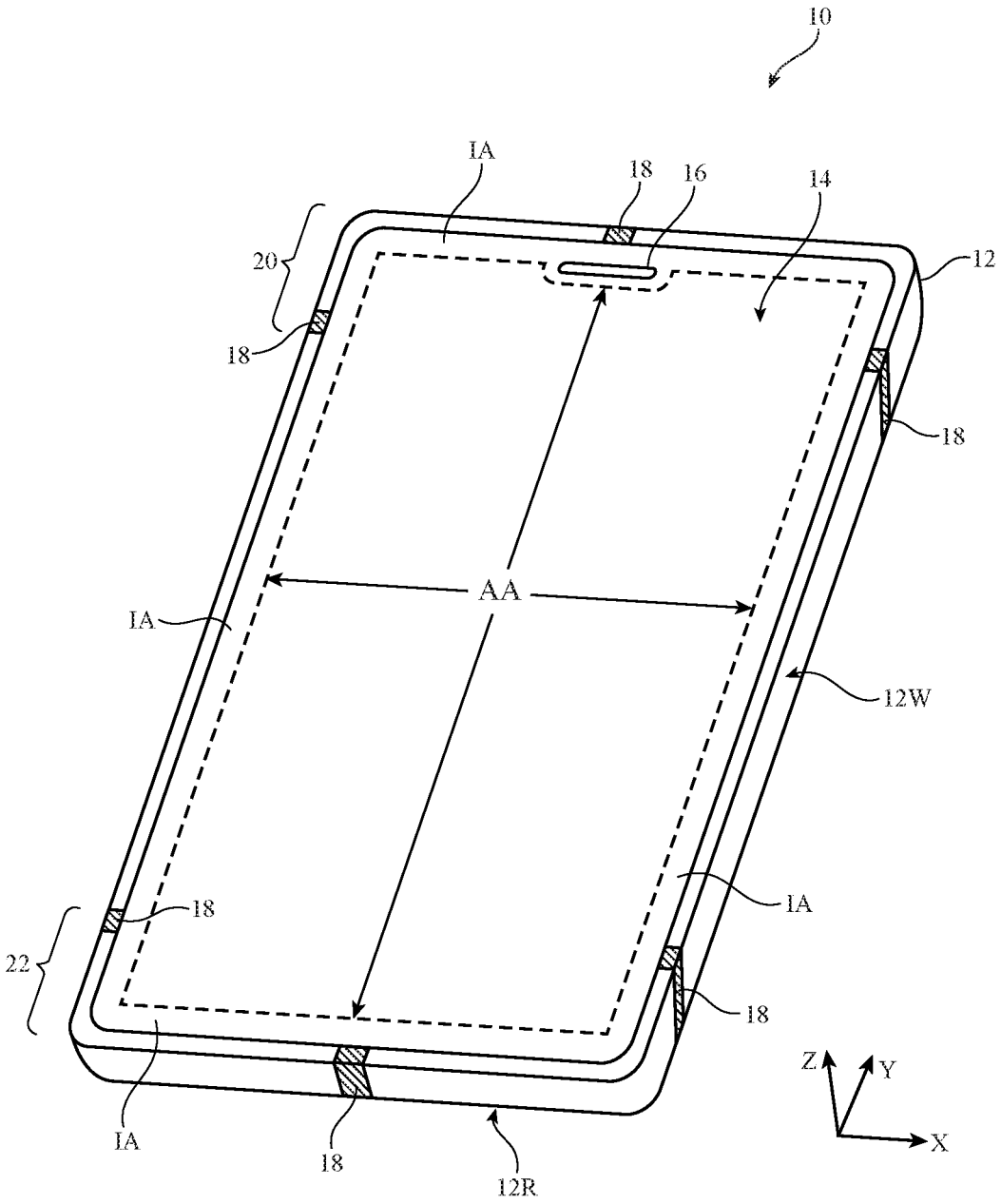
FIG. 1 is a perspective view of an illustrative electronic device in accordance with some embodiments.

Electronic devices such as electronic device 10 of FIG. 1 may be provided with wireless circuitry (sometimes referred to herein as wireless communications circuitry). The wireless circuitry may be used to support wireless communications in multiple wireless communications bands. Communications bands (sometimes referred to herein as frequency bands) handled by the wireless circuitry can include satellite navigation system communications bands, cellular telephone communications bands, wireless local area network communications bands, near-field communications bands, ultra-wideband communications bands, or other wireless communications bands.

The wireless circuitry may include one or more antennas. The antennas of the wireless circuitry can include loop antennas, inverted-F antennas, strip antennas, planar inverted-F antennas, patch antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The conductive housing structures may include peripheral structures such as peripheral conductive structures that run around the periphery of the electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Peripheral structures 12W and conductive portions of rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding lip that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

Rear housing wall 12R may lie in a plane that is parallel to display 14. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide peripheral conductive housing structures 12W and/or conductive portions of rear housing wall 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 16 or a microphone port. Openings may be formed in housing 12 to form communications ports (e.g., an audio jack port, a digital data port, etc.) and/or audio ports for audio components such as a speaker and/or a microphone if desired.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of peripheral conductive structures 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 22 and 20 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 22 and 20. If desired, the ground plane that is under active area AA of display 14 and/or other metal structures in device 10 may have portions that extend into parts of the ends of device 10 (e.g., the ground may extend towards the dielectric-filled openings in regions 22 and 20), thereby narrowing the slots in regions 22 and 20.

In general, device 10 may include any suitable number of antennas (e.g., one or more, two or more, three or more, four or more, etc.). The antennas in device 10 may be located at opposing first and second ends of an elongated device housing (e.g., ends at regions 22 and 20 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. There may be, for example, two peripheral conductive segments in peripheral conductive housing structures 12W (e.g., in an arrangement with two gaps 18), three peripheral conductive segments (e.g., in an arrangement with three gaps 18), four peripheral conductive segments (e.g., in an arrangement with four gaps 18), six peripheral conductive segments (e.g., in an arrangement with six gaps 18), etc. The segments of peripheral conductive housing structures 12W that are formed in this way may form parts of antennas in device 10 if desired.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 12W and may form antenna slots, gaps 18, and other structures in device 10. Polymer or other dielectric may fill these grooves and other housing openings. In some situations, housing openings that form antenna slots and other structure may be filled with a dielectric such as air.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area behind display 14 that is available for antennas within device 10. For example, active area AA of display 14 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency bandwidth.

In a typical scenario, device 10 may have one or more upper antennas and one or more lower antennas (as an example). An upper antenna may, for example, be formed at the upper end of device 10 in region 20. A lower antenna may, for example, be formed at the lower end of device 10 in region 22. Additional antennas may be formed along the edges of housing 12 extending between regions 20 and 22 if desired. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, ultra-wideband communications, etc.

Figure 2:
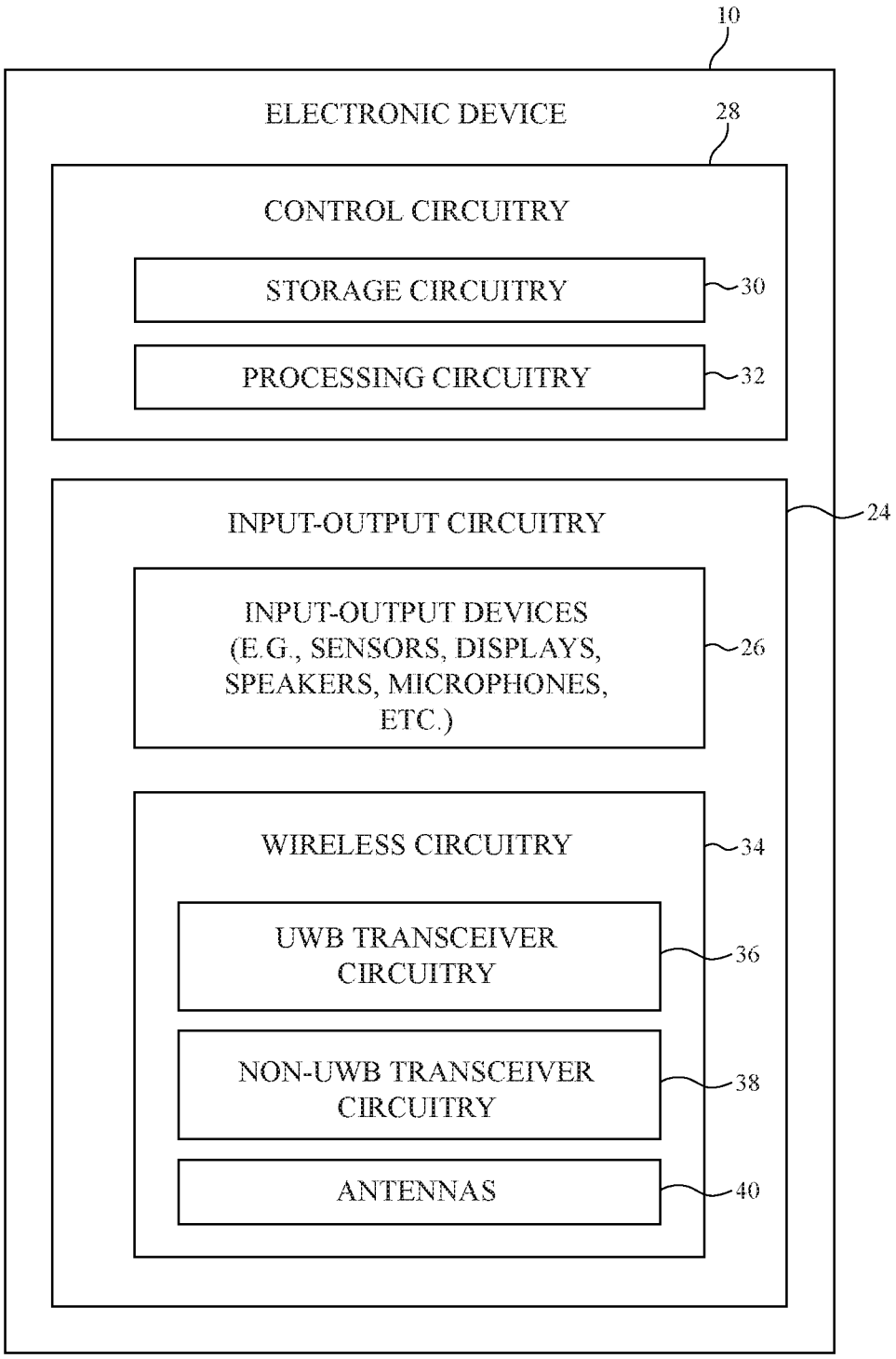
FIG. 2 is a schematic diagram of illustrative circuitry in an electronic device in accordance with some embodiments.

A schematic diagram of illustrative components that may be used in device 10 is shown in FIG. 2. As shown in FIG. 2, device 10 may include control circuitry 28. Control circuitry 28 may include storage such as storage circuitry 30. Storage circuitry 30 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 28 may include processing circuitry such as processing circuitry 32. Processing circuitry 32 may be used to control the operation of device 10. Processing circuitry 32 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 30 (e.g., storage circuitry 30 may include non-transitory (tangible) computer readable storage media that stores the software code). The software code may sometimes be referred to as program instructions, software, data, instructions, or code. Software code stored on storage circuitry 30 may be executed by processing circuitry 32.

Control circuitry 28 may be used to run software on device 10 such as external node location applications, satellite navigation applications, internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as Wi-Fi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols (e.g., global positioning system (GPS) protocols, global navigation satellite system (GLONASS) protocols, etc.), IEEE 802.15.4 ultra-wideband communications protocols or other ultra-wideband communications protocols, etc. Each communications protocol may be associated with a corresponding radio access technology (RAT) that specifies the physical connection methodology used in implementing the protocol.

Device 10 may include input-output circuitry 24. Input-output circuitry 24 may include input-output devices 26. Input-output devices 26 may be used to allow data to be supplied to device 10 and to allow data to be provided from device 10 to external devices. Input-output devices 26 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 24 may include wireless circuitry such as wireless circuitry 34 (sometimes referred to herein as wireless communications circuitry 34) for wirelessly conveying radio-frequency signals. To support wireless communications, wireless circuitry 34 may include radio-frequency (RF) transceiver circuitry formed from one or more integrated circuits, power amplifier circuitry, low-noise input amplifiers, passive RF components, one or more antennas such as antennas 40, transmission lines, and other circuitry for handling RF wireless signals. Wireless signals can also be sent using light (e.g., using infrared communications).

While control circuitry 28 is shown separately from wireless circuitry 34 in the example of FIG. 2 for the sake of clarity, wireless circuitry 34 may include processing circuitry that forms a part of processing circuitry 32 and/or storage circuitry that forms a part of storage circuitry 30 of control circuitry 28 (e.g., portions of control circuitry 28 may be implemented on wireless circuitry 34). As an example, control circuitry 28 (e.g., processing circuitry 32) may include baseband processor circuitry or other control components that form a part of wireless circuitry 34.

Wireless circuitry 34 may include radio-frequency transceiver circuitry for handling various radio-frequency communications bands. For example, wireless circuitry 34 may include ultra-wideband (UWB) transceiver circuitry 36 that supports communications using the IEEE 802.15.4 protocol and/or other ultra-wideband communications protocols. Ultra-wideband radio-frequency signals may be based on an impulse radio signaling scheme that uses band-limited data pulses. Ultra-wideband signals may have any desired bandwidths such as bandwidths between 499 MHz and 1331 MHz, bandwidths greater than 500 MHz, etc. The presence of lower frequencies in the baseband may sometimes allow ultra-wideband signals to penetrate through objects such as walls. In an IEEE 802.15.4 system, a pair of electronic devices may exchange wireless time stamped messages. Time stamps in the messages may be analyzed to determine the time of flight of the messages and thereby determine the distance (range) between the devices and/or an angle between the devices (e.g., an angle of arrival of incoming radio-frequency signals). Ultra-wideband transceiver circuitry 36 may operate (i.e., convey radio-frequency signals) in frequency bands such as an ultra-wideband communications band between about 5 GHz and about 8.3 GHz (e.g., a 6.5 GHz UWB communications band, an 8 GHz UWB communications band, and/or at other suitable frequencies).

As shown in FIG. 2, wireless circuitry 34 may also include non-UWB transceiver circuitry 38. Non-UWB transceiver circuitry 38 may handle communications bands other than UWB communications bands such as 2.4 GHz and 5 GHz bands for Wi-Fi® (IEEE 802.11) communications or communications in other wireless local area network (WLAN) bands, the 2.4 GHz Bluetooth® communications band or other wireless personal area network (WPAN) bands, and/or cellular telephone frequency bands such as a cellular low band (LB) from 600 to 960 MHz, a cellular low-midband (LMB) from 1410 to 1510 MHz, a cellular midband (MB) from 1710 to 2170 MHz, a cellular high band (HB) from 2300 to 2700 MHz, a cellular ultra-high band (UHB) from 3300 to 5000 MHz, or other communications bands between 600 MHz and 5000 MHz or other suitable frequencies (as examples).

Non-UWB transceiver circuitry 38 may handle voice data and non-voice data. Wireless circuitry 34 may include circuitry for other short-range and long-range wireless links if desired. For example, wireless circuitry 34 may include 60 GHz transceiver circuitry (e.g., millimeter wave transceiver circuitry), circuitry for receiving television and radio signals, paging system transceivers, near field communications (NFC) circuitry, etc.

Wireless circuitry 34 may include antennas 40. Antennas 40 may be formed using any suitable types of antenna structures. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of two or more of these designs, etc. If desired, one or more of antennas 40 may be cavity-backed antennas.

Different types of antennas may be used for different bands and combinations of bands. For example, one type of antenna may be used in forming a local wireless link antenna and another type of antenna may be used in forming a remote wireless link antenna. Dedicated antennas may be used for conveying radio-frequency signals in a UWB communications band or, if desired, antennas 40 can be configured to convey both radio-frequency signals in a UWB communications band and radio-frequency signals in a non-UWB communications band (e.g., wireless local area network signals and/or cellular telephone signals). Antennas 40 can include two or more antennas for handling ultra-wideband wireless communication. In one suitable arrangement that is described herein as an example, antennas 40 include one or more groups of three antennas (sometimes referred to herein as triplets of antennas) for handling ultra-wideband wireless communication. In yet another suitable arrangement, antennas 40 may include a triplet of sets of antennas, where each set of antenna includes four antennas that are tuned to four respective frequencies (e.g., antennas 40 may include three sets of four antennas for handling ultra-wideband wireless communication). Antennas 40 may include one or more doublets of antennas for handling ultra-wideband wireless communication if desired.

Space is often at a premium in electronic devices such as device 10. In order to minimize space consumption within device 10, the same antenna 40 may be used to cover multiple frequency bands. In one suitable arrangement that is described herein as an example, each antenna 40 that is used to perform ultra-wideband wireless communication may be a multi-band antenna that conveys radio-frequency signals in at least two ultra-wideband communications bands (e.g., the 6.5 GHz UWB communications band and the 8.0 GHz UWB communications band). In another suitable arrangement that is described herein as an example, each antenna 40 may convey radio-frequency signals in a single ultra-wideband communications band but antennas 40 may include different antennas that cover different ultra-wideband frequencies. Radio-frequency signals that are conveyed in UWB communications bands (e.g., using a UWB protocol) may sometimes be referred to herein as UWB signals or UWB radio-frequency signals. Radio-frequency signals in frequency bands other than the UWB communications bands (e.g., radio-frequency signals in cellular telephone frequency bands, WPAN frequency bands, WLAN frequency bands, etc.) may sometimes be referred to herein as non-UWB signals or non-UWB radio-frequency signals.

Figure 3:
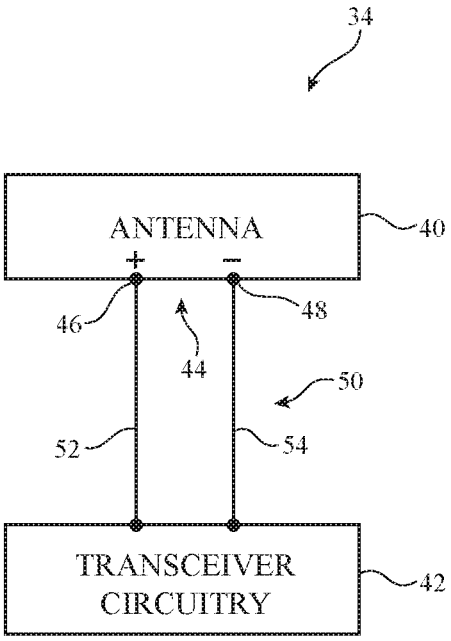
FIG. 3 is a schematic diagram of illustrative wireless circuitry in accordance with some embodiments.

A schematic diagram of wireless circuitry 34 is shown in FIG. 3. As shown in FIG. 3, wireless circuitry 34 may include transceiver circuitry 42 (e.g., UWB transceiver circuitry 36 or non-UWB transceiver circuitry 38 of FIG. 2) that is coupled to a given antenna 40 using a radio-frequency transmission line path such as radio-frequency transmission line path 50.

To provide antenna structures such as antenna 40 with the ability to cover different frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components that tune the antenna over communications (frequency) bands of interest. The tunable components may be part of a tunable filter or tunable impedance matching network, may be part of an antenna resonating element, may span a gap between an antenna resonating element and antenna ground, etc.

Radio-frequency transmission line path 50 may include one or more radio-frequency transmission lines (sometimes referred to herein simply as transmission lines). Radio-frequency transmission line path 50 (e.g., the transmission lines in radio-frequency transmission line path 50) may include a positive signal conductor such as positive signal conductor 52 and a ground signal conductor such as ground conductor 54.

The transmission lines in radio-frequency transmission line path 50 may, for example, include coaxial cable transmission lines (e.g., ground conductor 54 may be implemented as a grounded conductive braid surrounding signal conductor 52 along its length), stripline transmission lines (e.g., where ground conductor 54 extends along two sides of signal conductor 52), a microstrip transmission line (e.g., where ground conductor 54 extends along one side of signal conductor 52), coaxial probes realized by a metalized via, edge-coupled microstrip transmission lines, edge-coupled stripline transmission lines, waveguide structures (e.g., coplanar waveguides or grounded coplanar waveguides), combinations of these types of transmission lines and/or other transmission line structures, etc. In one suitable arrangement that is sometimes described herein as an example, radio-frequency transmission line path 50 may include a stripline transmission line coupled to transceiver circuitry 42 and a microstrip transmission line coupled between the stripline transmission line and antenna 40.

Transmission lines in radio-frequency transmission line path 50 may be integrated into rigid and/or flexible printed circuit boards. In one suitable arrangement, radio-frequency transmission line path 50 may include transmission line conductors (e.g., signal conductors 52 and ground conductors 54) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network may include components such as inductors, resistors, and capacitors used in matching the impedance of antenna 40 to the impedance of radio-frequency transmission line path 50. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Radio-frequency transmission line path 50 may be coupled to antenna feed structures associated with antenna 40. As an example, antenna 40 may form an inverted-F antenna, a planar inverted-F antenna, a patch antenna, or other antenna having an antenna feed 44 with a positive antenna feed terminal such as terminal 46 and a ground antenna feed terminal such as ground antenna feed terminal 48. Signal conductor 52 may be coupled to positive antenna feed terminal 46 and ground conductor 54 may be coupled to ground antenna feed terminal 48. Other types of antenna feed arrangements may be used if desired. For example, antenna 40 may be fed using multiple feeds each coupled to a respective port of transceiver circuitry 42 over a corresponding transmission line. If desired, signal conductor 52 may be coupled to multiple locations on antenna 40 (e.g., antenna 40 may include multiple positive antenna feed terminals coupled to signal conductor 52 of the same radio-frequency transmission line path 50). Switches may be interposed on the signal conductor between transceiver circuitry 42 and the positive antenna feed terminals if desired (e.g., to selectively activate one or more positive antenna feed terminals at any given time). The illustrative feeding configuration of FIG. 3 is merely illustrative.

During operation, device 10 may communicate with external wireless equipment. If desired, device 10 may use radio-frequency signals conveyed between device 10 and the external wireless equipment to identify a location of the external wireless equipment relative to device 10. Device 10 may identify the relative location of the external wireless equipment by identifying a range to the external wireless equipment (e.g., the distance between the external wireless equipment and device 10) and the angle of arrival (AoA) of radio-frequency signals from the external wireless equipment (e.g., the angle at which radio-frequency signals are received by device 10 from the external wireless equipment).

Figure 4:
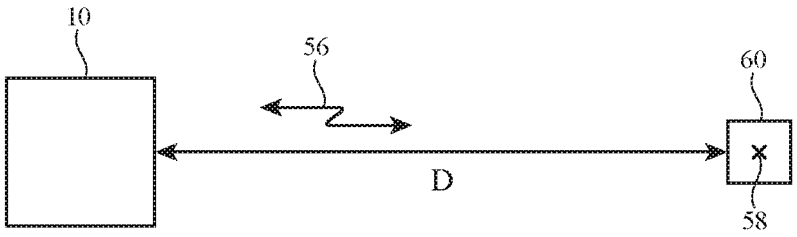
FIG. 4 is a diagram of an illustrative electronic device in wireless communication with an external node in a network in accordance with some embodiments.

FIG. 4 is a diagram showing how device 10 may determine a distance D between device 10 and external wireless equipment such as wireless network node 60 (sometimes referred to herein as wireless equipment 60, wireless device 60, external device 60, or external equipment 60). Node 60 may include devices that are capable of receiving and/or transmitting radio-frequency signals such as radio-frequency signals 56. Node 60 may include tagged devices (e.g., any suitable object that has been provided with a wireless receiver and/or a wireless transmitter), electronic equipment (e.g., an infrastructure-related device), and/or other electronic devices (e.g., devices of the type described in connection with FIG. 1, including some or all of the same wireless communications capabilities as device 10).

For example, node 60 may be a laptop computer, a tablet computer, a somewhat smaller device such as a wrist-watch device, pendant device, headphone device, earpiece device, headset device (e.g., virtual or augmented reality headset devices), or other wearable or miniature device, a handheld device such as a cellular telephone, a media player, or other small portable device. Node 60 may also be a set-top box, a camera device with wireless communications capabilities, a desktop computer, a display into which a computer or other processing circuitry has been integrated, a display without an integrated computer, or other suitable electronic equipment. Node 60 may also be a key fob, a wallet, a book, a pen, or other object that has been provided with a low-power transmitter (e.g., an RFID transmitter or other transmitter). Node 60 may be electronic equipment such as a thermostat, a smoke detector, a Bluetooth® Low Energy (Bluetooth LE) beacon, a Wi-Fi® wireless access point, a wireless base station, a server, a heating, ventilation, and air conditioning (HVAC) system (sometimes referred to as a temperature-control system), a light source such as a light-emitting diode (LED) bulb, a light switch, a power outlet, an occupancy detector (e.g., an active or passive infrared light detector, a microwave detector, etc.), a door sensor, a moisture sensor, an electronic door lock, a security camera, or other device. Device 10 may also be one of these types of devices if desired.

As shown in FIG. 4, device 10 may communicate with node 60 using wireless radio-frequency signals 56. Radio-frequency signals 56 may include Bluetooth® signals, near-field communications signals, wireless local area network signals such as IEEE 802.11 signals, millimeter wave communication signals such as signals at 60 GHz, UWB signals, other radio-frequency wireless signals, infrared signals, etc. In one suitable arrangement that is described herein by example, radio-frequency signals 56 are UWB signals conveyed in multiple UWB communications bands such as the 6.5 GHz and 8 GHz UWB communications bands. Radio-frequency signals 56 may be used to determine and/or convey information such as location and orientation information. For example, control circuitry 28 in device 10 (FIG. 2) may determine the location 58 of node 60 relative to device 10 using radio-frequency signals 56.

In arrangements where node 60 is capable of sending or receiving communications signals, control circuitry 28 (FIG. 2) on device 10 may determine distance D using radio-frequency signals 56 of FIG. 4. The control circuitry may determine distance D using signal strength measurement schemes (e.g., measuring the signal strength of radio-frequency signals 56 from node 60) or using time-based measurement schemes such as time of flight measurement techniques, time difference of arrival measurement techniques, angle of arrival measurement techniques, triangulation methods, time-of-flight methods, using a crowdsourced location database, and other suitable measurement techniques. This is merely illustrative, however. If desired, the control circuitry may use information from Global Positioning System receiver circuitry, proximity sensors (e.g., infrared proximity sensors or other proximity sensors), image data from a camera, motion sensor data from motion sensors, and/or using other circuitry on device 10 to help determine distance D. In addition to determining the distance D between device 10 and node 60, the control circuitry may determine the orientation of device 10 relative to node 60.

Figure 5:
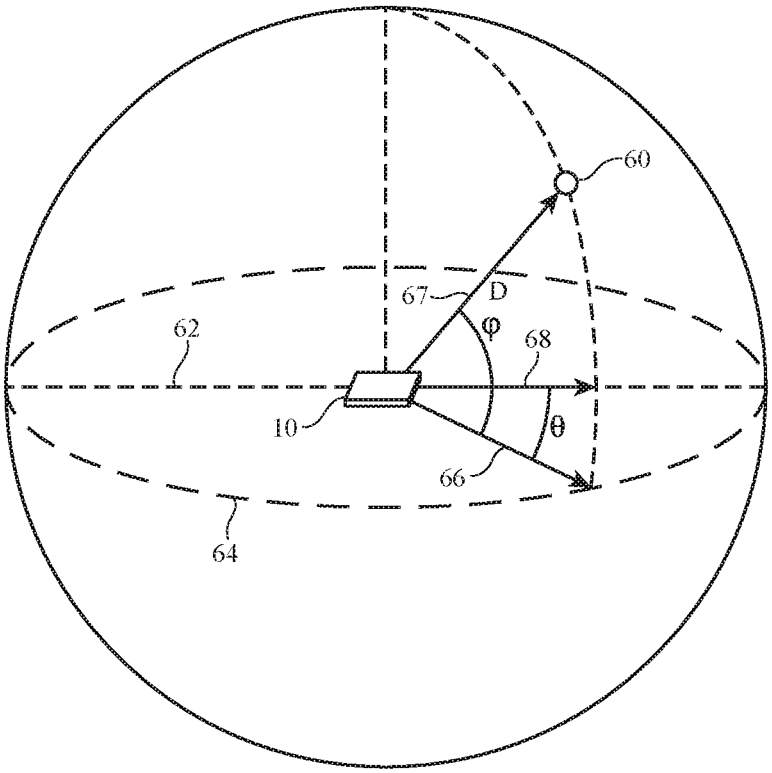
FIG. 5 is a diagram showing how the location (e.g., range and angle of arrival) of an external node in a network may be determined relative to an electronic device in accordance with some embodiments.

FIG. 5 illustrates how the position and orientation of device 10 relative to nearby nodes such as node 60 may be determined. In the example of FIG. 5, the control circuitry on device 10 (e.g., control circuitry 28 of FIG. 2) uses a horizontal polar coordinate system to determine the location and orientation of device 10 relative to node 60. In this type of coordinate system, the control circuitry may determine an azimuth angle θ and/or an elevation angle φ to describe the position of nearby nodes 60 relative to device 10. The control circuitry may define a reference plane such as local horizon 64 and a reference vector such as reference vector 68. Local horizon 64 may be a plane that intersects device 10 and that is defined relative to a surface of device 10 (e.g., the front or rear face of device 10). For example, local horizon 64 may be a plane that is parallel to or coplanar with display 14 of device 10 (FIG. 1). Reference vector 68 (sometimes referred to as the "north" direction) may be a vector in local horizon 64. If desired, reference vector 68 may be aligned with longitudinal axis 62 of device 10 (e.g., an axis running lengthwise down the center of device 10 and parallel to the longest rectangular dimension of device 10, parallel to the Y-axis of FIG. 1). When reference vector 68 is aligned with longitudinal axis 62 of device 10, reference vector 68 may correspond to the direction in which device 10 is being pointed.

Azimuth angle θ and elevation angle φ may be measured relative to local horizon 64 and reference vector 68. As shown in FIG. 5, the elevation angle φ (sometimes referred to as altitude) of node 60 is the angle between node 60 and local horizon 64 of device 10 (e.g., the angle between vector 67 extending between device 10 and node 60 and a coplanar vector 66 extending between device 10 and local horizon 64). The azimuth angle θ of node 60 is the angle of node 60 around local horizon 64 (e.g., the angle between reference vector 68 and vector 66). In the example of FIG. 5, the azimuth angle θ and elevation angle φ of node 60 are greater than 0°.

If desired, other axes besides longitudinal axis 62 may be used to define reference vector 68. For example, the control circuitry may use a horizontal axis that is perpendicular to longitudinal axis 62 as reference vector 68. This may be useful in determining when nodes 60 are located next to a side portion of device 10 (e.g., when device 10 is oriented side-to-side with one of nodes 60).

After determining the orientation of device 10 relative to node 60, the control circuitry on device 10 may take suitable action. For example, the control circuitry may send information to node 60, may request and/or receive information from 60, may use display 14 (FIG. 1) to display a visual indication of wireless pairing with node 60, may use speakers to generate an audio indication of wireless pairing with node 60, may use a vibrator, a haptic actuator, or other mechanical element to generate haptic output indicating wireless pairing with node 60, may use display 14 to display a visual indication of the location of node 60 relative to device 10, may use speakers to generate an audio indication of the location of node 60, may use a vibrator, a haptic actuator, or other mechanical element to generate haptic output indicating the location of node 60, and/or may take other suitable action.

In one suitable arrangement, device 10 may determine the distance between the device 10 and node 60 and the orientation of device 10 relative to node 60 using two or more ultra-wideband antennas. The ultra-wide band antennas may receive radio-frequency signals from node 60 (e.g., radio-frequency signals 56 of FIG. 4). Time stamps in the wireless communication signals may be analyzed to determine the time of flight of the wireless communication signals and thereby determine the distance (range) between device 10 and node 60. Additionally, angle of arrival (AoA) measurement techniques may be used to determine the orientation of electronic device 10 relative to node 60 (e.g., azimuth angle θ and elevation angle φ).

In angle of arrival measurement, node 60 transmits a radio-frequency signal to device 10 (e.g., radio-frequency signals 56 of FIG. 4). Device 10 may measure a delay in arrival time of the radio-frequency signals between the two or more ultra-wideband antennas. The delay in arrival time (e.g., the difference in received phase at each ultra-wideband antenna) can be used to determine the angle of arrival of the radio-frequency signal (and therefore the angle of node 60 relative to device 10). Once distance D and the angle of arrival have been determined, device 10 may have knowledge of the precise location of node 60 relative to device 10.

Figure 6:
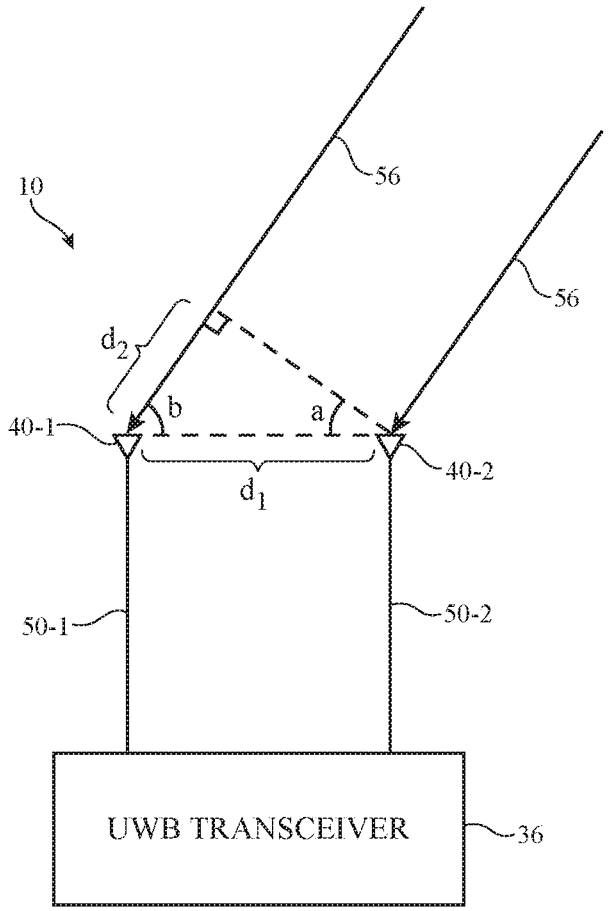
FIG. 6 is a diagram showing how illustrative antennas in an electronic device may be used for detecting angle of arrival in accordance with some embodiments.

FIG. 6 is a schematic diagram showing how angle of arrival measurement techniques may be used to determine the orientation of device 10 relative to node 60. As shown in FIG. 6, device 10 may include multiple antennas (e.g., a first antenna 40-1 and a second antenna 40-2) coupled to UWB transceiver circuitry 36 over respective radio-frequency transmission line paths (e.g., a first radio-frequency transmission line path 50-1 and a second radio-frequency transmission line path 50-2).

Antennas 40-1 and 40-2 may each receive radio-frequency signals 56 from node 60 (FIG. 5). Antennas 40-1 and 40-2 may be laterally separated by a distance $d_1$, where antenna 40-1 is farther away from node 60 than antenna 40-2 (in the example of FIG. 6). Therefore, radio-frequency signals 56 travel a greater distance to reach antenna 40-1 than antenna 40-2. The additional distance between node 60 and antenna 40-1 is shown in FIG. 6 as distance $d_2$. FIG. 6 also shows angles a and b (where a+b=90°).

Distance $d_2$ may be determined as a function of angle a or angle b (e.g., $d_2=d_1*\sin(a)$ or $d_2=d_1*\cos(b)$). Distance $d_2$ may also be determined as a function of the phase difference between the signal received by antenna 40-1 and the signal received by antenna 40-2 (e.g., $d_2=(PD)*\lambda/(2*7\pi)$), where PD is the phase difference (sometimes written "Δφ") between the signal received by antenna 40-1 and the signal received by antenna 40-2, and λ is the wavelength of radio-frequency signals 56. Device 10 may include phase measurement circuitry coupled to each antenna to measure the phase of the received signals and to identify phase difference PD (e.g., by subtracting the phase measured for one antenna from the phase measured for the other antenna). The two equations for $d_2$ may be set equal to each other (e.g., $d_1*\sin(a)=(PD)*\lambda/(2*\pi)$) and rearranged to solve for the angle a (e.g., $a=\sin^{-1}((PD)*\lambda/(2*d_1))$ or the angle b. Therefore, the angle of arrival may be determined (e.g., by control circuitry 28 of FIG. 2) based on the known (predetermined) distance $d_1$ between antennas 40-1 and 40-2, the detected (measured) phase difference PD between the signal received by antenna 40-1 and the signal received by antenna 40-2, and the known wavelength (frequency) of the received radio-frequency signals 56. Angles a and/or b of FIG. 6 may be converted to spherical coordinates to obtain azimuth angle θ and elevation angle φ of FIG. 5, for example. Control circuitry 28 (FIG. 2) may determine the angle of arrival of radio-frequency signals 56 by calculating one or both of azimuth angle θ and elevation angle φ.

Distance $d_1$ may be selected to ease the calculation for phase difference PD between the signal received by antenna 40-1 and the signal received by antenna 40-2. For example, $d_1$ may be less than or equal to one half of the wavelength (e.g., effective wavelength) of the received radio-frequency signals 56 (e.g., to avoid multiple phase difference solutions).

With two antennas for determining angle of arrival (as in FIG. 6), the angle of arrival within a single plane may be determined. For example, antennas 40-1 and 40-2 in FIG. 6 may be used to determine azimuth angle θ of FIG. 5. A third antenna may be included to enable angle of arrival determination in multiple planes (e.g., azimuth angle θ and elevation angle φ of FIG. 5 may both be determined). The three antennas in this scenario may form a so-called triplet of antennas, where each antenna in the triplet is arranged to lie on a respective corner of a right triangle (e.g., the triplet may include antennas 40-1 and 40-2 of FIG. 6 and a third antenna located at distance $d_1$ from antenna 40-1 in a direction perpendicular to the vector between antennas 40-1 and 40-2). Triplets of antennas 40 may be used to determine angle of arrival in two planes (e.g., to determine both azimuth angle θ and elevation angle φ of FIG. 5). Triplets of antennas 40 and/or doublets of antennas (e.g., a pair of antennas such as antennas 40-1 and 40-2 of FIG. 6) may be used in device 10 to determine angle of arrival. If desired, different doublets of antennas may be oriented orthogonally with respect to each other in device 10 to recover angle of arrival in two dimensions (e.g., using two or more orthogonal doublets of antennas 40 that each measure angle of arrival in a single respective plane).

Figure 7:
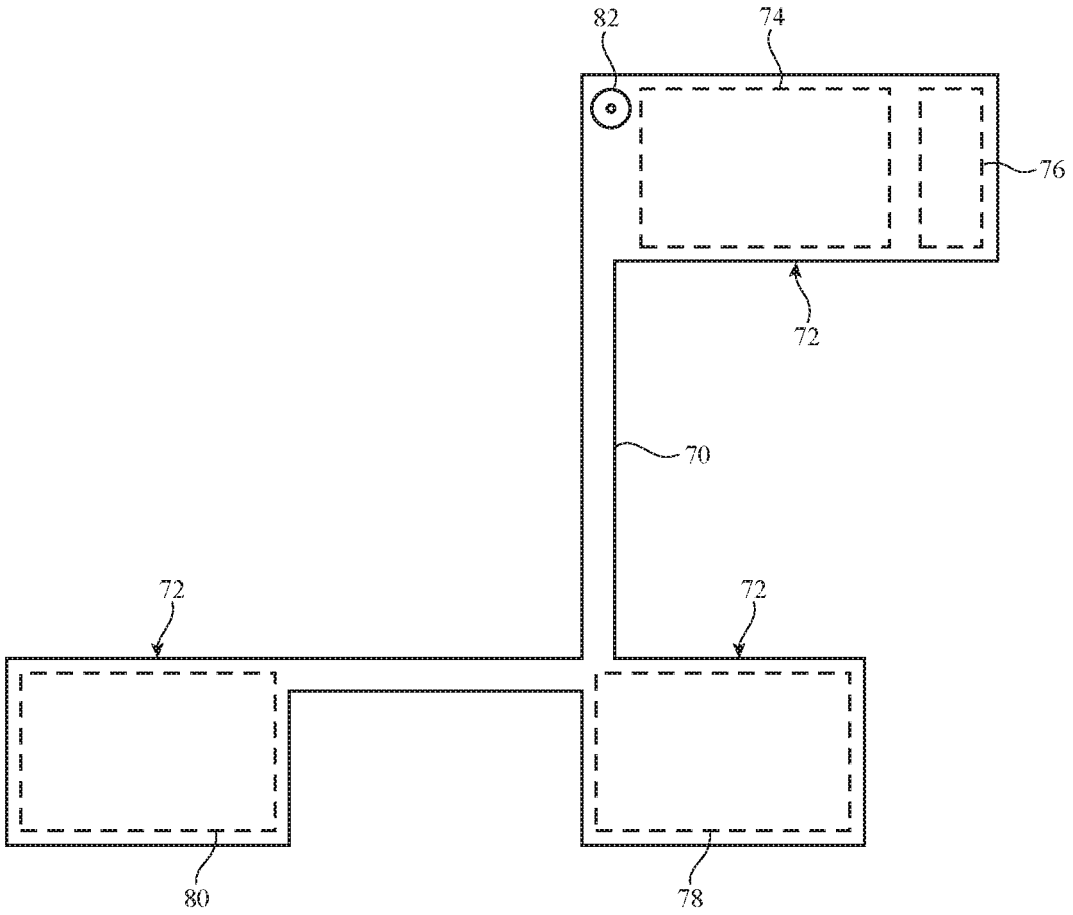
FIG. 7 is a schematic diagram of an illustrative flexible printed circuit having antennas for detecting range and angle of arrival in accordance with some embodiments.

If desired, each antenna in a triplet or doublet of antennas used by device 10 for performing ultra-wideband communications may be mounted to a common substrate. FIG. 7 is a top-down view showing how antennas 40 may be mounted to a common substrate such as a flexible printed circuit. As shown in FIG. 7, two or more antennas for performing ultra-wideband communications (e.g., a triplet of antennas) may be mounted to flexible printed circuit 70. Flexible printed circuit 70 may be bent or folded along one or more axes if desired (e.g., to accommodate the presence of other electronic device components in the vicinity of flexible printed circuit 70).

Flexible printed circuit 70 may include portions 72 (sometimes referred to herein as stub portions 72 or stubs 72). Antennas 40 for performing ultra-wideband communications may be formed within regions 80, 78, and 74 on stubs 72 of flexible printed circuit 70. For example, a triplet of antennas 40 for performing ultra-wideband communications may include a first antenna in region 74, a second antenna in region 78, and a third antenna in region 80. In another suitable arrangement, antennas 40 may include a triplet of sets of antennas, where each set of antennas includes two or more antennas 40 (e.g., four antennas 40) and respective sets are formed in regions 80, 78, and 74. One or more of stubs 72 on flexible printed circuit 70 may include a non-UWB antenna (e.g., in region 76) for conveying non-UWB signals such as a wireless local area network antenna for conveying radio-frequency signals in a wireless local area network communications band.

Radio-frequency transmission line paths (e.g., radio-frequency transmission line path 50 of FIG. 3) may be formed on flexible printed circuit 70 and may be coupled to the antennas in regions 80, 78, and 74. Flexible printed circuit 70 may include one or more radio-frequency connectors 82 (e.g., at one or more of stubs 72 or elsewhere in flexible printed circuit 70). Radio-frequency connector 82 may couple the radio-frequency transmission line paths on flexible printed circuit 70 to transceiver circuitry in device 10 (e.g., transceiver circuitry 42 of FIG. 3). The transceiver circuitry may, for example, be mounted to a different substrate such as a main logic board for device 10.

The example of FIG. 7 is merely illustrative. In general, flexible printed circuit 70 may have any desired shape. Flexible printed circuit 70 need not include stubs 72 (e.g., flexible printed circuit 70 may have a rectangular shape or other shapes). One of regions 80, 78, and 74 may be omitted in scenarios where only a doublet of antennas is formed on flexible printed circuit 70 for performing ultra-wideband communications. In another suitable arrangement, flexible printed circuit 70 of FIG. 7 may be replaced with a rigid printed circuit board or other substrates for antennas 40. If desired, other components may be mounted to flexible printed circuit 70 (e.g., input-output devices 26 or portions of control circuitry 28 of FIG. 2, additional antennas, etc.).

Any desired antenna structures may be used for implementing the antennas 40 in regions 74, 80, and 78 of FIG. 7 (e.g., for implementing at least antennas 40-1 and 40-2 of FIG. 6 for conveying UWB signals). In one suitable arrangement that is sometimes described herein as an example, planar inverted-F antenna structures may be used for implementing antennas 40. Antennas that are implemented using planar inverted-F antenna structures may sometimes be referred to herein as planar inverted-F antennas.

Figure 8:
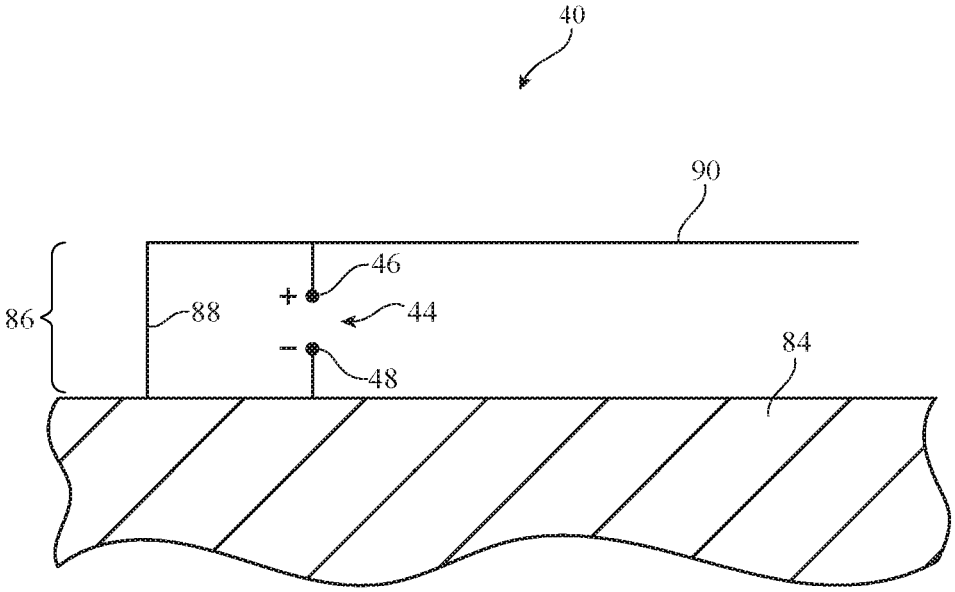
FIG. 8 is a schematic diagram of illustrative inverted-F antenna structures in accordance with some embodiments.

FIG. 8 is a schematic diagram of inverted-F antenna structures that may be used to form antenna 40 (e.g., a given one of antennas 40-1 and 40-2 of FIG. 6). As shown in FIG. 8, antenna 40 may include an antenna resonating element such as antenna resonating element 86 and an antenna ground such as antenna ground 84. Antenna resonating element 86 may include a resonating element arm 90 (sometimes referred to herein as an antenna resonating element arm) that is shorted to antenna ground 84 by return path 88. Antenna 40 may be fed by coupling a transmission line (e.g., a transmission line in radio-frequency transmission line path 50 of FIG. 3) to positive antenna feed terminal 46 and ground antenna feed terminal 48 of antenna feed 44. Positive antenna feed terminal 46 may be coupled to resonating element arm 90 and ground antenna feed terminal 48 may be coupled to antenna ground 84. Return path 88 may be coupled between resonating element arm 90 and antenna ground 84 in parallel with antenna feed 44. The length of resonating element arm 90 may determine the response (resonant) frequency of the antenna.

Figure 9:
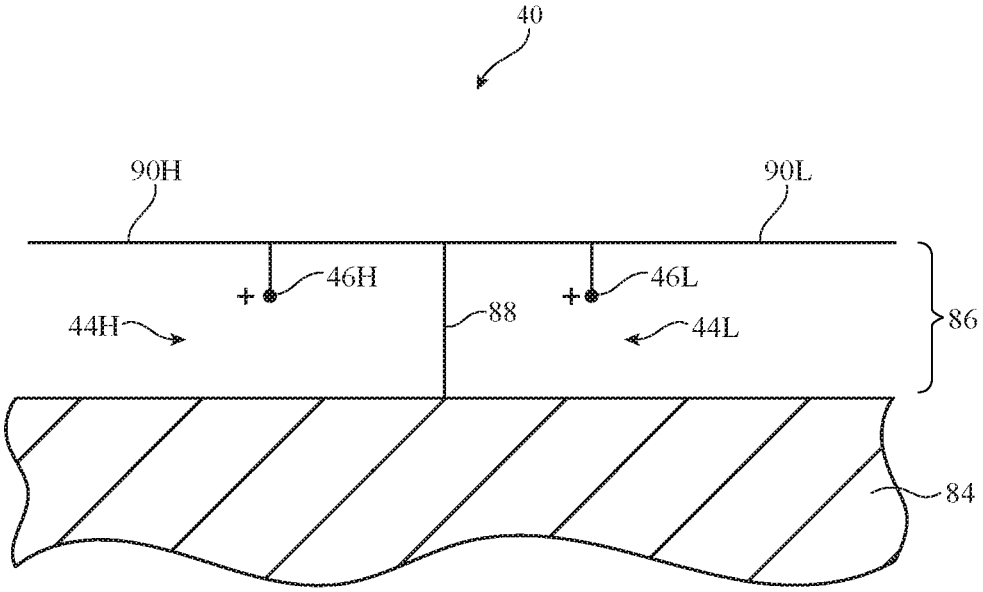
FIG. 9 is a schematic diagram of illustrative dual-band inverted-F antenna structures in accordance with some embodiments.

In the example of FIG. 8, antenna 40 is configured to cover only a single frequency band. If desired, antenna resonating element 86 may include multiple resonating element arms 90 that configure antenna 40 to cover multiple frequency bands. FIG. 9 is a schematic diagram of dual-band inverted-F antenna structures that may be used to form antenna 40 (e.g., a given one of antennas 40-1 and 40-2 of FIG. 6). As shown in FIG. 9, antenna resonating element 86 includes a first resonating element arm 90L and a second resonating element arm 90H extending from opposing sides of return path 88.

The length of first resonating element arm 90L (sometimes referred to herein as low band arm 90L) may be selected to radiate in a first frequency band and the length of second resonating element arm 90H (sometimes referred to herein as high band arm 90H) may be selected to radiate in a second frequency band at higher frequencies than the first frequency band. As an example, low band arm 90L may have a length that configures low band arm 90L to radiate in the 6.5 GHz UWB communications band whereas high band arm 90H has a length that configures high band arm 90H to radiate in the 8.0 GHz UWB communications band.

Antenna 40 of FIG. 9 may be fed using two antenna feeds such as antenna feed 44H and antenna feed 44L. Antenna feed 44H may include a positive antenna feed terminal 46H coupled to high band arm 90H. Antenna feed 44L may include a positive antenna feed terminal 46L coupled to low band arm 90L. The ground antenna feed terminals of antenna feeds 44L and 44H are not shown in the example of FIG. 9 for the sake of clarity. If desired, antenna feeds 44L and 44H may share the same ground antenna feed terminal. Positive antenna feed terminals 46H and 46L may both be coupled to the same transmission line (e.g., to the same signal conductor 52 as shown in FIG. 3). This may, for example, optimize antenna efficiency of antenna 40 in both the frequency band covered by low band arm 90L and the frequency band covered by high band arm 90H (e.g., because antenna current may be conveyed to each resonating element arm over the corresponding positive antenna feed terminal without first shorting to ground over return path 88).

In one suitable arrangement that is sometimes described herein as an example, antenna 40 may be a dual-band planar inverted-F antenna. When configured as a dual-band planar inverted-F antenna, resonating element arms 90H and 90L may be formed using a conductive structure (e.g., a conductive trace or patch, sheet metal, conductive foil, etc.) that extends across a planar lateral area above antenna ground 84.

Figure 10:
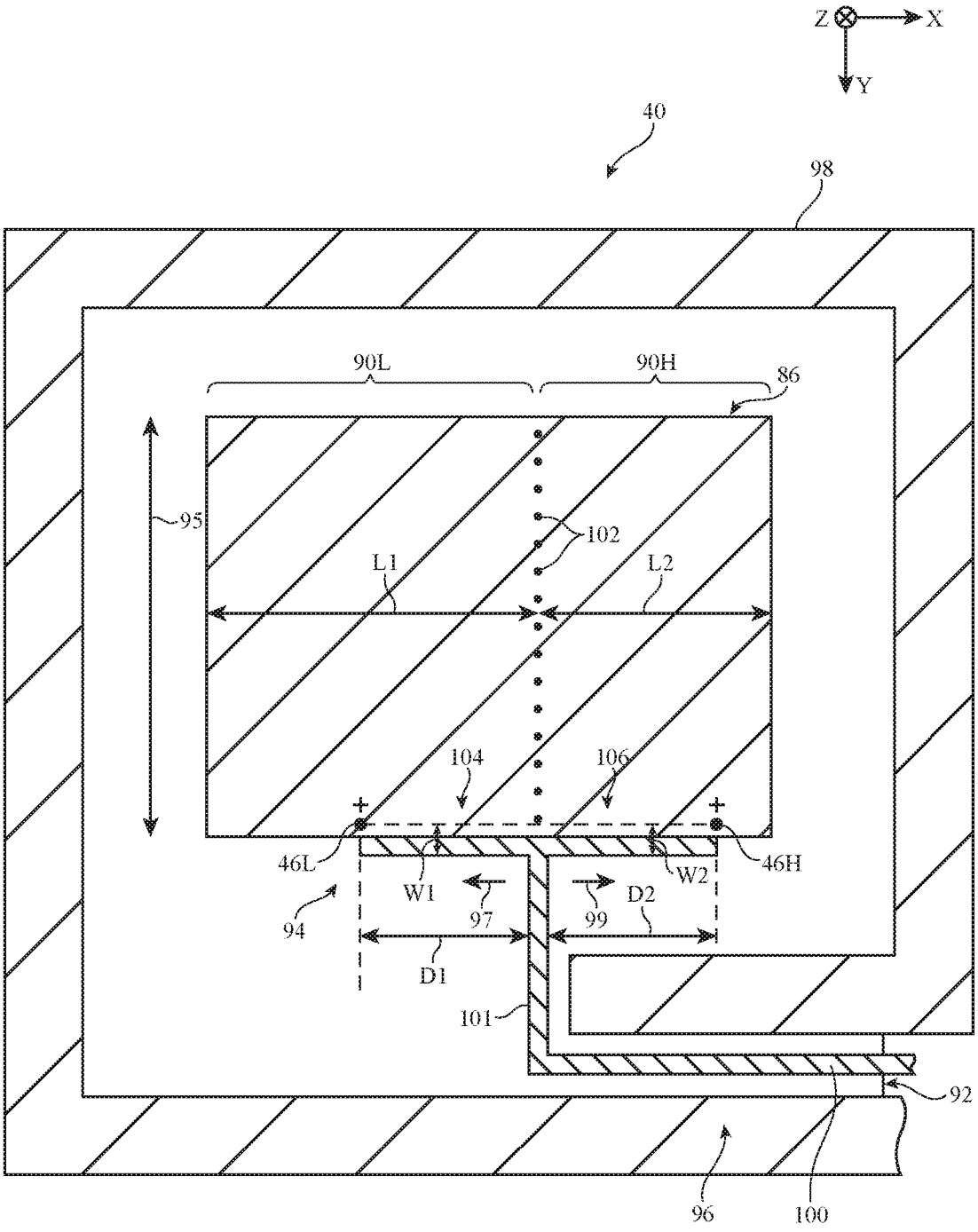
FIG. 10 is a bottom view of an illustrative dual-band planar inverted-F antenna that conveys radio-frequency signals and that includes impedance matching transmission line structures in in accordance with some embodiments.

FIG. 10 is a bottom-up view of dual-band planar inverted-F antenna structures that may be used to form antenna 40 (e.g., a given one of antennas 40-1 and 40-2 of FIG. 6). As shown in FIG. 10, antenna resonating element 86 of antenna 40 (e.g., a dual-band planar inverted-F antenna) may be formed from conductive structures such as conductive traces on a surface of an underlying dielectric substrate 92 (e.g., on an upper-most surface of dielectric substrate 92). Dielectric substrate 92 may be formed from any desired dielectric materials such as epoxy, plastic, ceramic, glass, foam, polyimide, liquid crystal polymer, or other materials. In one suitable arrangement that is described herein as an example, dielectric substrate 92 is a flexible printed circuit substrate having stacked layers of flexible printed circuit material (e.g., polyimide, liquid crystal polymer, etc.). Dielectric substrate 92 may therefore sometimes be referred to herein as flexible printed circuit substrate 92.

As shown in FIG. 10, antenna resonating element 86 may have a planar shape with a length equal to the sum of the length L2 of high band arm 90H and the length L1 of low band arm 90L. Antenna resonating element 86 (e.g., each of resonating element arms 90H and 90L) may have a perpendicular width 95 such that antenna resonating element 86 has a planar shape that laterally extends in a given plane (e.g., the X-Y plane of FIG. 10) parallel to the antenna ground (e.g., antenna ground 84 of FIG. 9). In other words, low band arm 90L has length L1 and width 95 whereas high band arm 90H has length L2 and width 95. The example of FIG. 10 is merely illustrative and, if desired, low band arm 90L and/or high band arm 90H may have other shapes (e.g., shapes with cut-out regions to accommodate other components in the vicinity of antenna 40, shapes having any desired number of curved and/or straight edges, etc.). In these scenarios, length L1 may be the greatest lateral dimension of low band arm 90L and length L2 may be the greatest lateral dimension of high band arm 90H, as an example.

Length L2 may be selected to configure high band arm 90H to radiate in a relatively high frequency band such as the 8.0 GHz UWB communications band. Length L1 may be selected to configure low band arm 90L to radiate in a relatively low frequency band such as the 6.5 GHz UWB communications band. For example, length L2 may be approximately equal to (e.g., within 15% of) one-quarter of the effective wavelength corresponding to a frequency in the 8.0 GHz UWB communications band. Similarly, length L1 may be approximately equal to one-quarter of the effective wavelength corresponding to a frequency in the 6.5 GHz UWB communications band. These effective wavelengths are modified from free-space wavelengths by a constant value associated with the dielectric material used to form flexible printed circuit substrate 92 (e.g., the effective wavelengths are found by multiplying the freespace wavelengths by a constant value that is based on the dielectric constant dk of flexible printed circuit substrate 92). This example is merely illustrative and, in general, any desired frequency bands (e.g., UWB communications bands) may be covered by high band arm 90H and low band arm 90L.

Low band arm 90L may be separated from high band arm 90H in antenna resonating element 86 by a fence of conductive vias 102. Conductive vias 102 extend from the upper-most surface of flexible printed circuit substrate 92, through flexible printed circuit substrate 92, and to an underlying ground plane (e.g., in the direction of the Z-axis of FIG. 10). The fence of conductive vias 102 may form the return path for antenna 40 (e.g., return path 88 of FIG. 9).

Each conductive via 102 may be separated from one or more adjacent conductive vias 102 by a sufficiently narrow distance such that the portion of antenna resonating element 86 to the left of the fence of conductive vias 102 appears as an open circuit (infinite impedance) to antenna currents in the 8.0 GHz UWB communications band and such that the portion of antenna resonating element 86 to the right of the fence of conductive vias 102 appears as an open circuit (infinite impedance) to antenna currents in the 6.5 GHz UWB communications band. As an example, each conductive via 102 in the fence may be separated from one or more adjacent conductive vias 102 by one-sixth of the wavelength covered by high band arm 90H, one-eighth of the wavelength covered by high band arm 90H, one-tenth of the wavelength covered by high band arm 90H, one-fifteenth of the wavelength covered by high band arm 90H, less than one-fifteenth of the wavelength covered by high band arm 90H, less than one-sixth of the wavelength covered by high band arm 90H, etc.

If desired, a grounded shielding ring 98 may laterally surround antenna resonating element 86 at the upper-most surface of flexible printed circuit substrate 92. Grounded shielding ring 98 may be formed from conductive traces on the surface of flexible printed circuit substrate 92. The conductive traces of grounded shielding ring 98 may be shorted to the antenna ground (e.g., underlying planar ground traces) by fences of conductive vias extending through flexible printed circuit substrate 92 (not shown in FIG. 10 for the sake of clarity). Grounded shielding ring 98 may serve to isolate and shield antenna 40 from electromagnetic interference.

Grounded shielding ring 98, the conductive vias coupled to grounded shielding ring 98, and the underlying planar ground traces may collectively form antenna ground 84 of FIG. 9 and may form (define) a conductive antenna cavity for antenna 40 that serves to optimize radio-frequency performance (e.g., antenna efficiency and bandwidth) for antenna 40. The antenna ground may include ground traces on one or more layers of flexible printed circuit substrate 92 beneath the upper-most layer of flexible printed circuit substrate 92. The ground traces may include a planar ground traces extending underneath (e.g., overlapping) substantially all of antenna 40. If desired, the ground traces may also include a ring of ground traces or ground traces in other shapes overlapping grounded shielding ring 98 but formed on a layer of flexible printed circuit substrate 92 between the planar ground trace and the upper-most layer of flexible printed circuit substrate 92. Each layer of ground traces in antenna 40 may be coupled together using conductive vias if desired (e.g., so that all of the ground traces are held at the same ground potential).

Antenna 40 of FIG. 10 may be fed using a radio-frequency transmission line path (e.g., radio-frequency transmission line path 50 of FIG. 3). The radio-frequency transmission line path may include a first transmission line such as stripline transmission line 96 (sometimes referred to herein simply as stripline 96) and a second transmission line such as microstrip transmission line 94 (sometimes referred to herein simply as microstrip 94). Microstrip 94 may couple stripline 96 to antenna resonating element 86.

For example, stripline 96 may include signal trace 100 (e.g., a conductive trace that forms part of signal conductor 52 of FIG. 3). Stripline 96 may be coupled to positive antenna feed terminals 46L and 46H on antenna resonating element 86 through microstrip 94. The signal conductor for microstrip 94 may include signal trace segments 101, 104, and 106 (e.g., conductive traces that form respective segments of the signal conductor for microstrip 94 and thus signal conductor 52 of FIG. 3, and that may therefore sometimes be referred to herein as conductive traces, signal traces, or segments 101, 104, and 106). Signal trace segment 101 may be coupled to signal trace 100 of stripline 96. Signal trace segment 101 may couple signal trace segments 104 and 106 to signal trace 101. Signal trace segment 104 may be coupled to positive antenna feed terminal 46L on low band arm 90L by a conductive via extending through at least one layer of flexible printed circuit substrate 92. Signal trace segment 106 may be coupled to positive antenna feed terminal 46H on high band arm 90H by a conductive via extending through at least one layer of flexible printed circuit substrate 92. Signal trace 100 and signal trace segments 104, 106, and 101 may each be formed from conductive traces on the same layer of flexible printed circuit substrate 92 (e.g., a layer that is vertically interposed between the planar ground trace for antenna 40 and the uppermost layer in flexible printed circuit substrate 92).

Stripline 96 may exhibit a corresponding impedance (e.g., a 50 Ohm impedance). In practice, it can be difficult to ensure that the impedance of stripline 96 is matched to both the impedance of low band arm 90L at positive antenna feed terminal 46L (e.g., in the 6.5 GHz UWB communications band) and the impedance of high band arm 90H at positive antenna feed terminal 46H (e.g., in the 8.0 GHz UWB communications band). If care is not taken, impedance discontinuities between stripline 96 and antenna resonating element 86 may generate undesirable signal reflections that limit the overall antenna efficiency for antenna 40 in one or more frequency bands.

In order to help match the impedance of stripline 96 to the impedance of positive antenna feed terminals 46L and 46H, signal trace segments 104 and 106 may be configured to form impedance matching structures for antenna 40 (e.g., microstrip 94 may both convey radio-frequency signals for antenna 40 and serve as an impedance matching structure that matches the impedance of stripline 96 to the impedance of antenna resonating element 86). Signal trace segments 104 and 106 may therefore sometimes also be referred to herein as impedance matching segments 104 and 106 or impedance matching traces 104 and 106.

Signal trace segment 104 may extend laterally from signal trace segment 101 to the location of positive antenna feed terminal 46L. Signal trace segment 106 may extend laterally from signal trace segment 101 to the location of positive antenna feed terminal 46H. The dimensions of signal trace segments 104 and 106 (and the locations of positive antenna feed terminals 46L and 46H) may be selected to match the impedance of stripline 96 to the impedance of antenna resonating element 86.

For example, signal trace segment 104 may have a length D1 extending from signal trace segment 101 to positive antenna feed terminal 46L and may have a perpendicular width W1. Similarly, signal trace segment 106 may have a length D2 extending from signal trace segment 101 to positive antenna feed terminal 46H. Adjusting length D1, length D2, width W1, width W2, the location of positive antenna feed terminal 46L, and/or the location of positive antenna feed terminal 46H may serve to adjust the impedance matching performed by microstrip 94 in the frequency bands handled by low band arm 90L and high band arm 90H.

For example, width W1, length D1, and/or the position of positive antenna feed terminal 46L may selected so that microstrip 94 exhibits a 50 Ohm impedance to the left of signal trace segment 101 (e.g., in the direction of arrow 97) in the frequency band of low band arm 90L (e.g., in the 6.5 GHz UWB communications band) while simultaneously exhibiting an infinite (open circuit) impedance to the left of signal trace segment 101 in the frequency band of high band arm 90H (e.g., in the 8.0 GHz UWB communications band). Similarly, width W2, length D2, and/or the position of positive antenna feed terminal 46H may selected so that microstrip 94 exhibits a 50 Ohm impedance to the right of signal trace segment 101 (e.g., in the direction of arrow 99) in the frequency band of high band arm 90H (e.g., in the 8.0 GHz UWB communications band) while simultaneously exhibiting an infinite (open circuit) impedance to the right of signal trace segment 101 in the frequency band of low band arm 90L (e.g., in the 6.5 GHz UWB communications band). In this way, microstrip 94 may perform asymmetric impedance matching to either side of signal trace segment 101, thereby allowing stripline 96 to be impedance matched to positive antenna feed terminal 46L in the 6.5 GHz UWB communications band while simultaneously being impedance matched to positive antenna feed terminal 46H in the 8.0 GHz UWB communications band.

This example is merely illustrative and, in general, signal trace segments 104 and 106 may have any desired shapes (e.g., shapes having any number of curved and/or straight edges). Width W1 may be equal to width W2 or may be different than width W1. Length D1 may be different from length D2 or may be equal to length D2. In one suitable arrangement, signal trace segment 101 is aligned (e.g., along the X-axis of FIG. 10) with the fence of conductive vias 102 forming the return path for antenna resonating element 86. This is merely illustrative and, in general, signal trace segment 101 may be aligned with other locations on antenna resonating element 86. Grounded shielding ring 98 may be omitted if desired.

In the example of FIG. 10, antenna 40 is only capable of conveying radio-frequency signals with a single linear polarization. In other words, high band arm 90H conveys radio-frequency signals in the 8.0 GHz UWB communications band with a given linear polarization and low band arm 90L conveys radio-frequency signals in the 6.5 UWB communications band with the same linear polarization. Additional polarizations may be covered in device 10 by providing additional antennas oriented perpendicular to each other if desired. The example of FIG. 10 is merely illustrative. If desired, antenna resonating antenna 40 and/or grounded shielding ring 98 may have other shapes (e.g., shapes having any desired number of straight and/or curved edges).

Figure 11:
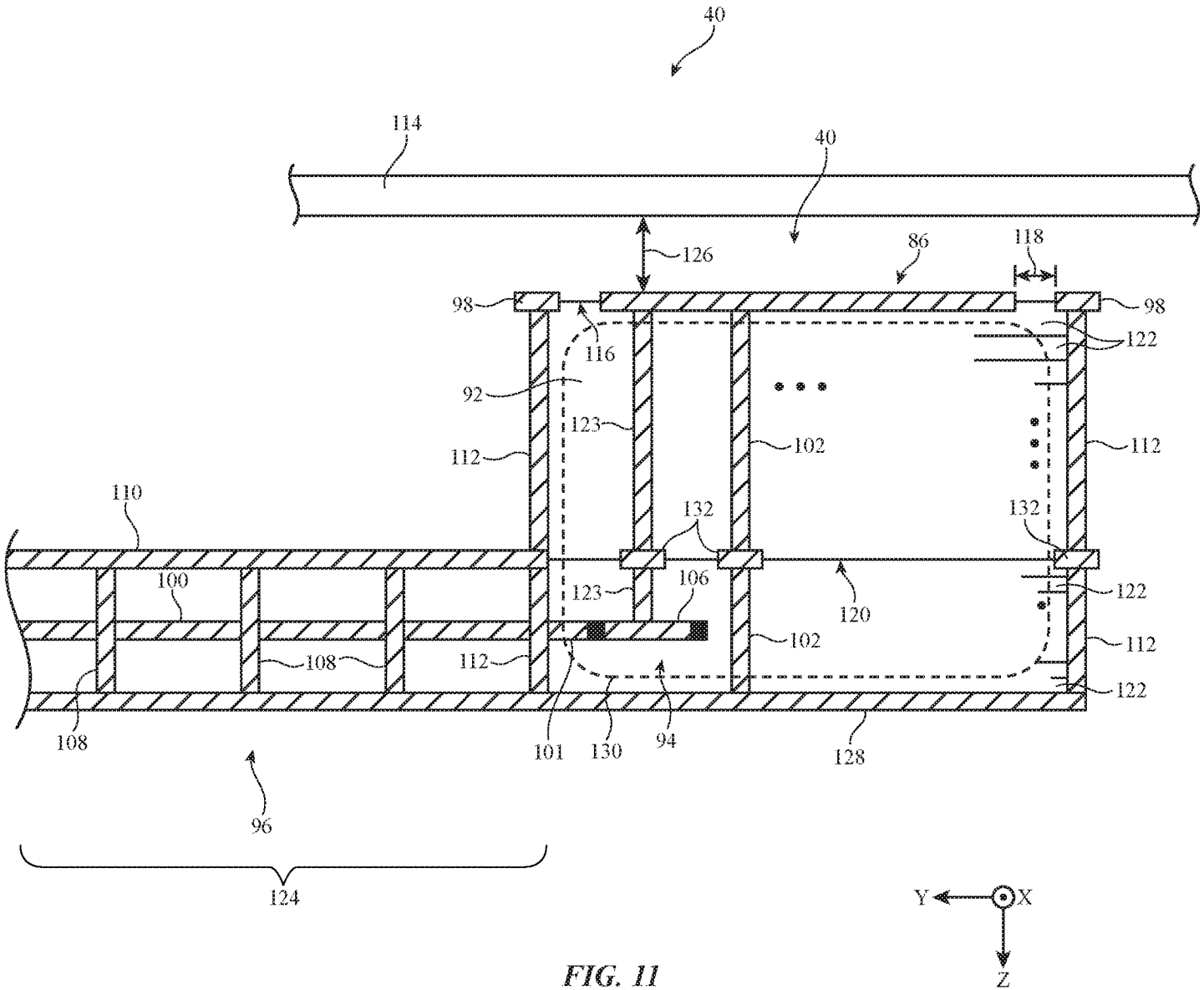
FIG. 11 is a cross-sectional side view of an illustrative dual-band planar inverted-F antenna on a flexible printed circuit substrate in accordance with some embodiments.

FIG. 11 is a cross-sectional side view of the dual-band planar inverted-F antenna of FIG. 10. As shown in FIG. 11, antenna resonating element 86 may be formed from conductive traces on surface 116 of flexible printed circuit substrate 92. Flexible printed circuit substrate 92 may include one or more stacked layers 122 of flexible printed circuit material (e.g., polyimide, liquid crystal polymer, etc.). This example is merely illustrative and, if desired, one or more additional layers 122 of flexible printed circuit substrate 92 may be formed over surface 116 and antenna resonating element 86.

Flexible printed circuit substrate 92 may include a tail 124 that extends beyond the lateral outline of antenna resonating element 86. Stripline 96 may be formed on tail 124. Flexible printed circuit 92 may include conductive traces that form a ground plane (layer) such as planar ground traces 128. Planar ground traces 128 may be formed on a surface of flexible printed circuit substrate 92 (as shown in the example of FIG. 11) or may be embedded within layers 122 of flexible printed circuit substrate 92. Planar ground traces 128 may form a part of stripline 96 and microstrip 94 for antenna 40 and may extend under antenna resonating element 86 (e.g., antenna resonating element 86 may overlap planar ground traces 128). Conductive vias 108 may extend through tail 124 of flexible printed circuit substrate 92 to short the planar ground traces 128 to additional ground traces 110 in stripline 96 (e.g., signal trace 100 of stripline 96 may be interposed between additional ground traces 110 and planar ground traces 128). This example is merely illustrative. In another suitable arrangement, signal trace 100 in stripline 96 may be laterally surrounded on two sides (e.g., in the X-Y plane) by additional grounded traces (e.g., additional grounded traces that at least partially overlap grounded shielding ring 98 of FIG. 10). Other transmission line structures may be used if desired.

Signal trace 100 may be coupled to signal trace segment 101 in microstrip 94. Conductive via 123 may extend from the signal conductor in microstrip 94 (e.g., signal trace 106 of FIG. 11) to antenna resonating element 86 (e.g., at positive antenna feed terminal 46H of FIG. 10). Conductive via 123 may be coupled to conductive contacts such as landing pads 132 at the interfaces between each layer 122 in flexible printed circuit substrate 92. While FIG. 11 only shows a single conductive via 123, antenna 40 may include two conductive vias 123 for coupling both signal trace segments 106 and 104 to positive antenna feed terminals 46H and 46L of FIG. 10, respectively.

Grounded shielding ring 98 may be formed on surface 116 of flexible printed circuit substrate 92. Grounded shielding ring 98 may surround some or all of the periphery of antenna resonating element 86 at surface 116. Grounded shielding ring 98 may be separated from antenna resonating element 86 by gap 118. Gap 118 may be large enough to allow for some tolerance in manufacturing antenna 40 while also being small enough to minimize the footprint of antenna 40 within device 10. As an example, gap 118 may be between 0.4 mm and 0.6 mm (e.g., 0.5 mm) in length. Grounded shielding ring 98 may be shorted to planar ground traces 128 by conductive vias such as conductive vias 112. Similarly, conductive vias 102 may extend from antenna resonating element 86 through flexible printed circuit substrate 92 to planar ground traces 128. Conductive vias 102 and 112 may be coupled to landing pads 132 at the interfaces between each layer 122 in flexible printed circuit substrate 92. Antenna 40 may include a fence of conductive vias 102 to form the return path for antenna 40 (e.g., return path 88 of FIG. 9).

Conductive vias 112, antenna resonating element 86, and planar ground traces 128 may define a continuous antenna cavity (volume) 130 for antenna 40. In general, the bandwidth of antenna 40 is proportional to the size of antenna cavity 130. The portion of surface 120 underlying antenna resonating element 86 may be free from grounded traces to maximize the size of antenna cavity 130 (e.g., allowing antenna cavity 130 to extend downward to planar ground traces 128). This may serve to maximize bandwidth and efficiency for antenna 40. Grounded shielding ring 98 and conductive vias 112 may also serve to shield antenna 40 from external electromagnetic interference.

As shown in FIG. 11, antenna 40 may be mounted within device 10 adjacent to a dielectric cover layer such as dielectric cover layer 114. Dielectric cover layer 114 may form a dielectric rear wall for device 10 (e.g., dielectric cover layer 114 of FIG. 11 may form part of rear housing wall 12R of FIG. 1) or may form a display cover layer for device 10 (e.g., dielectric cover layer 114 of FIG. 11 may be a display cover layer for display 14 of FIG. 1), as examples. Dielectric cover layer 114 may be formed from a visually opaque material, may be provided with pigment so that dielectric cover layer 114 is visually opaque, or may be provided with an ink layer that hides antenna 40 from view, if desired. Antenna resonating element 86 may be separated from dielectric cover layer 114 by gap 126, may be adhered to dielectric cover layer 114 using adhesive, or may be pressed against dielectric cover layer 114 if desired. Antenna 40 may convey radio-frequency signals through dielectric cover layer 114.

If desired, flexible printed circuit substrate 92 may form part of flexible printed circuit 70 or may be mounted to flexible printed circuit 70 of FIG. 7 (e.g., antenna 40 of FIG. 11 may be mounted in one of regions 80, 78, or 74 of FIG. 7). In order to further enhance the bandwidth covered by the antennas within each of regions 80, 78, and 74 of FIG. 7, each region may include a respective set of antennas 40 that are tuned to slightly different frequencies. The set of antennas may collectively exhibit a bandwidth that is greater than the bandwidth of the dual-band antenna of FIGS. 10 and 11.

Figure 12:
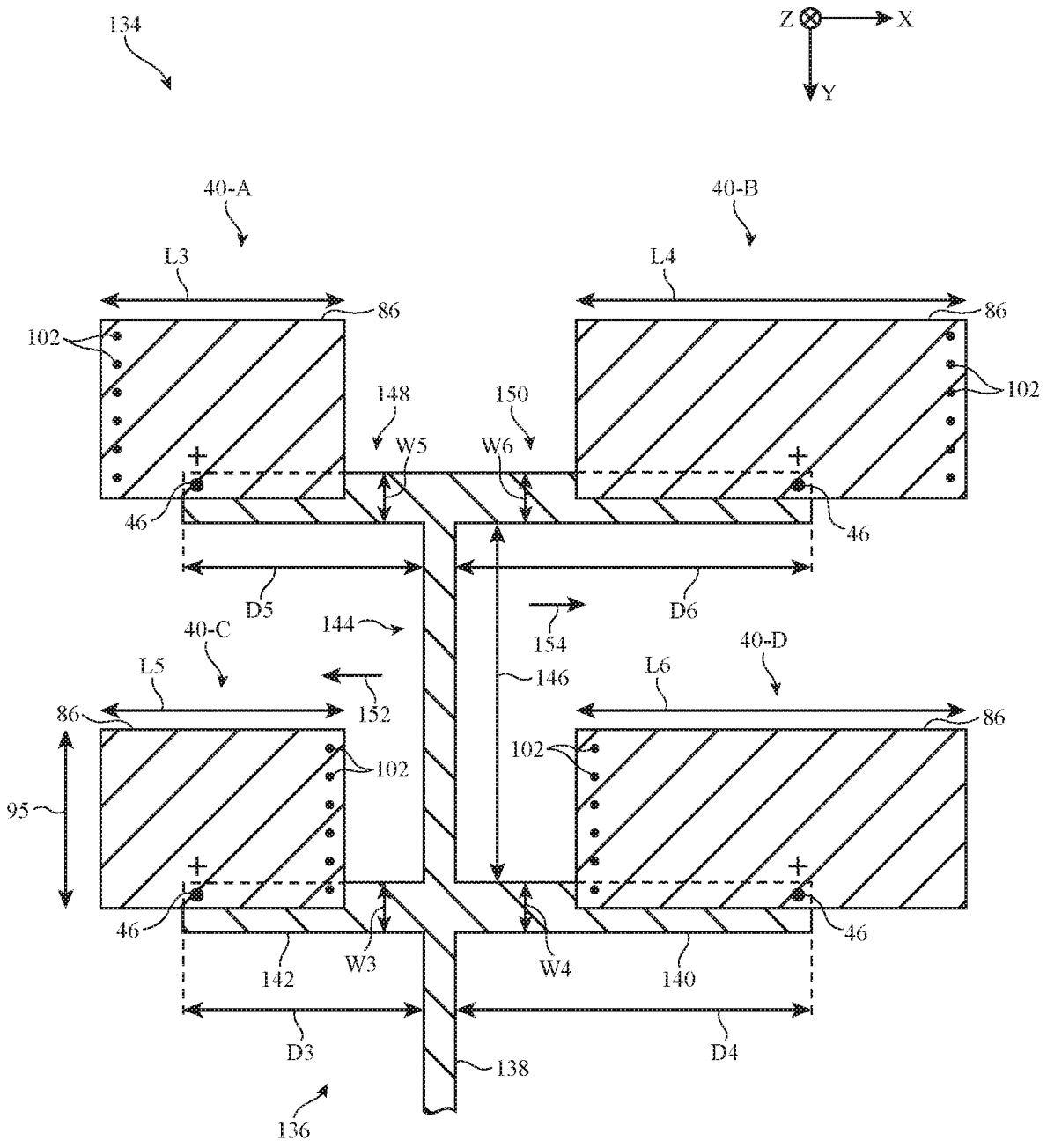
FIG. 12 is a bottom view of an illustrative set of antennas that may convey radio-frequency signals in multiple frequency bands with a relatively wide bandwidth in accordance with some embodiments.

FIG. 12 is a bottom-up view of an illustrative set 134 of antennas that may be formed in one of regions 80, 78, or 74 of FIG. 7 for performing ultra-wideband communications with a relatively large bandwidth. As shown in FIG. 12, set 134 may include four antennas 40 such as a first antenna 40-A, a second antenna 40-B, a third antenna 40-C, and a fourth antenna 40-D. Each antenna in set 134 may be fed using the same transmission line (e.g., a transmission line such as a stripline or microstrip having signal conductor 138).

In the example of FIG. 12, each of antennas 40-A, 40-B, 40-C, and 40-D is a planar inverted-F antenna having a corresponding antenna resonating element 86, a single resonating element arm (e.g., resonating element arm 90 of FIG. 8) with a corresponding width 95, and a corresponding fence of conductive vias 102 (e.g., for forming a return path for the antenna such as return path 88 of FIG. 8). Each antenna in set 134 may have the same width 95 or the antennas in set 134 may have different lateral widths.

Antennas 40-A, 40-B, 40-C, and 40-D may be configured to cover different frequencies. The response frequencies of antennas 40-A and 40-C may be selected to collectively cover the 8.0 GHz UWB communications band (e.g., with a wider bandwidth than in a scenario where only a single antenna is used to cover the 8.0 GHz UWB communications band) whereas the response frequencies of antennas 40-B and 40-D may be selected to collectively cover the 6.5 GHz UWB communications band (e.g., with a wider bandwidth than in a scenario where only a single antenna is used to cover the 6.5 GHz UWB communications band). For example, the antenna resonating element 86 in antenna 40-A may have a length L3 that configures antenna 40-A to resonate at a first frequency that is less than 8.0 GHz and greater than 6.5 GHz (e.g., 7.9 GHz, 7.8 GHz, 7.7 GHz, or any other desired frequency that is 300 MHz or less below 8.0 GHz), whereas the antenna resonating element 86 in antenna 40-C may have a length L5 that configures antenna 40-C to resonate at a second frequency that is greater than 8.0 GHz (e.g., 8.1 GHz, 8.2 GHz, 8.3 GHz, or any other desired frequency that 300 MHz or less greater than 8.0 GHz). Similarly, the antenna resonating element 86 in antenna 40-B may have a length L4 that configures antenna 40-B to resonate at a third frequency that is less than 6.5 GHz (e.g., 6.4 GHz, 6.3 GHz, 6.2 GHz, or any other desired frequency that is 300 MHz or less below 6.5 GHz), whereas the antenna resonating element 86 in antenna 40-D may have a length L6 that configures antenna 40-D to resonate at a fourth frequency that is greater than 6.5 GHz and less than 8.0 GHz (e.g., 6.6 GHz, 6.7 GHz, 6.8 GHz, or any other desired frequency that is 300 MHz or less greater than 6.5 GHz). Lengths L3, L4, L5, and L6 may, for example, be approximately equal to one-quarter of the effective wavelengths of operation of antennas 40-A, 40-B, 40-C, and 40-D, respectively. Collectively, the antennas in set 134 may cover both ultra-wideband communications bands with greater bandwidth than in scenarios where a signal dual-band antenna is used.

Signal trace 138 may be coupled to the positive antenna feed terminal 46 on antenna 40-C by signal trace 142 and may be coupled to the positive antenna feed terminal 46 on antenna 40-D by signal trace 140. Conductive vias may be used to couple signal traces 142 and 140 to positive antenna feed terminals 46 (e.g., conductive vias extending through the underlying flexible printed circuit substrate such as flexible printed circuit substrate 92 of FIGS. 10 and 11). Signal traces 142 and 140 may, for example, form the signal conductor of a microstrip transmission line that couples signal conductor 138 to antennas 40-C and 40-D.

Signal trace 142 may also be an impedance matching trace that is configured to match the impedance of signal trace 138 to the impedance of antenna 40-C at the second frequency. For example, the length D3 of signal trace 142, the width W3 of signal trace 142, and/or the position of the positive antenna feed terminal 46 for antenna 40-C may be selected to form a 50 Ohm impedance to the left of signal trace 138 (e.g., in the direction of arrow 152) at the second frequency while forming an infinite impedance at the fourth frequency (e.g., at the response frequency of antenna 40-D). Similarly, signal trace 140 may also be an impedance matching trace that is configured to match the impedance of signal trace 138 to the impedance of antenna 40-D at the fourth frequency. For example, the length D4 of signal trace 140, the width W4 of signal trace 140, and/or the position of the positive antenna feed terminal 46 for antenna 40-D may be selected to form a 50 Ohm impedance to the right of signal trace 138 (e.g., in the direction of arrow 154) at the fourth frequency while forming an infinite impedance at the second frequency (e.g., at the response frequency of antenna 40-C). This may serve to match the impedance of signal trace 138 to both antennas 40-C and 40-D in their respective frequency bands, thereby maximizing the antenna efficiency for antennas 40-C and 40-D.

The positive antenna feed terminal 46 on antenna 40-A may be coupled to signal trace 148 and the positive antenna feed terminal 46 on antenna 40-B may be coupled to signal trace 150 (e.g., using respective conductive vias). Signal traces 150 and 148 may extend from opposing sides of signal trace 144. Signal trace 144 may couple signal traces 150 and 148 to signal traces 142, 140, and 138. Signal traces 144, 148, and 150 may, for example, form the signal conductor of a microstrip transmission line that couples signal conductor 138 to antennas 40-A and 40-B.

Signal trace 148 may also be an impedance matching trace that is configured to match the impedance of signal trace 138 to the impedance of antenna 40-A at the first frequency. For example, the length D5 of signal trace 148, the width W5 of signal trace 148, and/or the position of the positive antenna feed terminal 46 for antenna 40-A may be selected to form a 50 Ohm impedance to the left of signal trace 144 (e.g., in the direction of arrow 152) at the first frequency while forming an infinite impedance at the third frequency (e.g., at the response frequency of antenna 40-B). Similarly, signal trace 150 may also be an impedance matching trace that is configured to match the impedance of signal trace 138 to the impedance of antenna 40-B at the third frequency. For example, the length D6 of signal trace 150, the width W6 of signal trace 150, and/or the position of the positive antenna feed terminal 46 for antenna 40-B may be selected to form a 50 Ohm impedance to the right of signal trace 144 (e.g., in the direction of arrow 154) at the third frequency while forming an infinite impedance at the first frequency (e.g., at the response frequency of antenna 40-A). This may serve to match the impedance of signal trace 138 to both antennas 40-A and 40-B in their respective frequency bands, thereby maximizing the antenna efficiency for antennas 40-A and 40-B. If desired, the dimensions of signal trace 144 may also contribute to the impedance matching for antennas 40-A and 40-B.

If desired, signal trace 144 may have a length 146 that is selected so that the radio-frequency signals at the positive antenna feed terminal 46 for antenna 40-C are in phase with the radio-frequency signals at the positive antenna feed terminal 46 for antenna 40-A and so that the radio-frequency signals at the positive antenna feed terminal 46 for antenna 40-B are in phase with the radio-frequency signals at the positive antenna feed terminal 46 for antenna 40-D. This may serve to maximize antenna efficiency for antennas 40-A and 40-C (e.g., in the 8.0 GHz UWB communications band) and to maximize antenna efficiency for antennas 40-B and 40-D (e.g., in the 6.5 GHz UWB communications band).

In the example of FIG. 12, the conductive vias 102 forming the return path for antenna 40-A are formed on the side (edge) of antenna resonating element 86 facing away from antenna 40-B and the conductive vias 102 forming the return path for antenna 40-B are formed on the side (edge) of antenna resonating element 86 facing away from antenna 40-A. In addition, the conductive vias 102 forming the return path for antenna 40-C are formed on the side of antenna resonating element 86 facing antenna 40-D and the conductive vias 102 forming the return path for antenna 40-D are formed on the side of antenna resonating element 86 facing antenna 40-C. This may serve to maximize antenna efficiency for set 134. This is merely illustrative and, in general, vias 102 may be formed on any desired side of the antenna resonating element 86 in each antenna 40-A, 40-B, 40-C, and 40-D. Signal trace segments 148, 150, 142, and 140 may have any desired shapes having any desired number of straight and/or curved edges. Lengths D5, D6, D3, and D4 may all be the same or two or more of these lengths may be different. Widths W5, W6, W3, and W4 may all be the same or two or more of these widths may be different. Antennas 40-A, 40-B, 40-C, and 40-D may have other shapes if desired (e.g., shapes having any desired number of curved and/or straight edges). Signal traces 148, 150, 144, 142, and 140 may sometimes be referred to herein as signal trace segments of the signal conductor for the same microstrip transmission line (e.g., a microstrip transmission line that couples signal trace 138 to each of the antennas in set 134).

Figure 13:
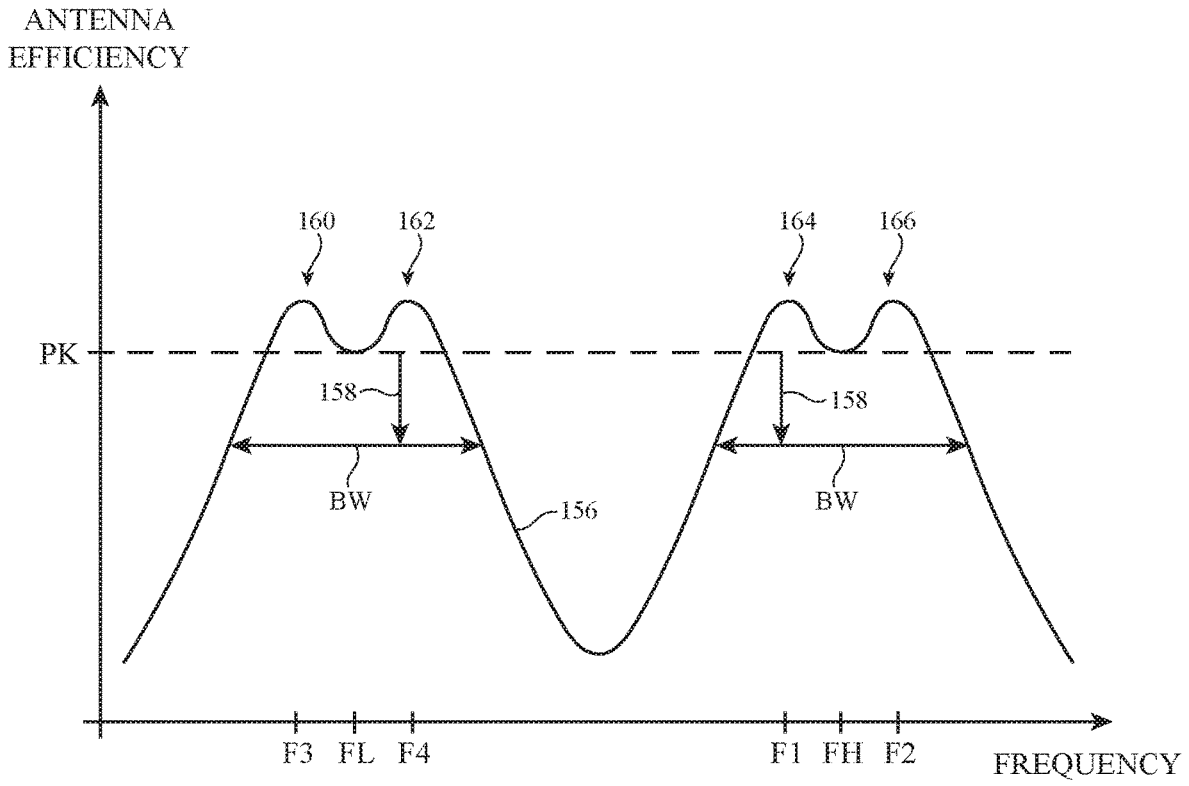
FIG. 13 is a plot of antenna performance (antenna efficiency) for an illustrative set of antennas of the type shown in FIG. 12 in accordance with some embodiments.

FIG. 13 is a plot of antenna performance (antenna efficiency) as a function of frequency for the set 134 of antennas 40-A, 40-B, 40-C, and 40-D of FIG. 12. As shown in FIG. 13, curve 156 plots the collective efficiency of each of antennas 40-A, 40-B, 40-C, and 40-D. The set 134 of antennas may be configured to cover a first ultra-wideband communications band at frequency FL (e.g., 6.5 GHz) and a second ultra-wideband communications band at frequency FH (e.g., 8.0 GHz). As shown by curve 156, antenna 40-A may exhibit response peak 164 at the first frequency (e.g., frequency F1), antenna 40-C may exhibit response peak 166 at the second frequency (e.g., frequency F2), antenna 40-B may exhibit response peak 160 at the third frequency (e.g., frequency F3), and antenna 40-D may exhibit response peak 162 at the fourth frequency (e.g., frequency F4). First frequency F1 may be 0-300 MHz less than frequency FH, second frequency F2 may be 0-300 greater than frequency FH, third frequency F3 may be 0-300 less than frequency FL, and frequency F4 may be 0-300 MHz greater than frequency FL.

In scenarios where the dual-band antenna of FIGS. 10 and 11 is used, low band arm 90L may cover a relatively narrow bandwidth about frequency FL and high band arm 90H may cover a relatively narrow bandwidth about frequency FH. In scenarios where set 134 of FIG. 12 is used, the relatively narrow bandwidths of antennas 40-A and 40-C may combine to provide set 134 with an expanded bandwidth about frequency FH. Similarly, the relatively narrow bandwidths of antennas 40-B and 40-D may combine to provide set 134 with an expanded bandwidth about frequency FL. For example, antennas 40-A and 40-C may exhibit an antenna efficiency PK at frequency FH that is within margin 158 greater than the antenna efficiency at which antennas 40-A and 40-C collectively exhibit fixed bandwidth BW (e.g., 500 MHz). Similarly, antennas 40-B and 40-D may exhibit an antenna efficiency PK at frequency FL that is within margin 158 greater than the antenna efficiency at which antennas 40-B and 40-D collectively exhibit fixed bandwidth BW (e.g., 500 MHz). Margin 158 may be less than or equal to 10 dB, for example. In this way, the antennas in device 10 may cover relatively wide bandwidths for performing ultra-wideband communications.

Figure 14:
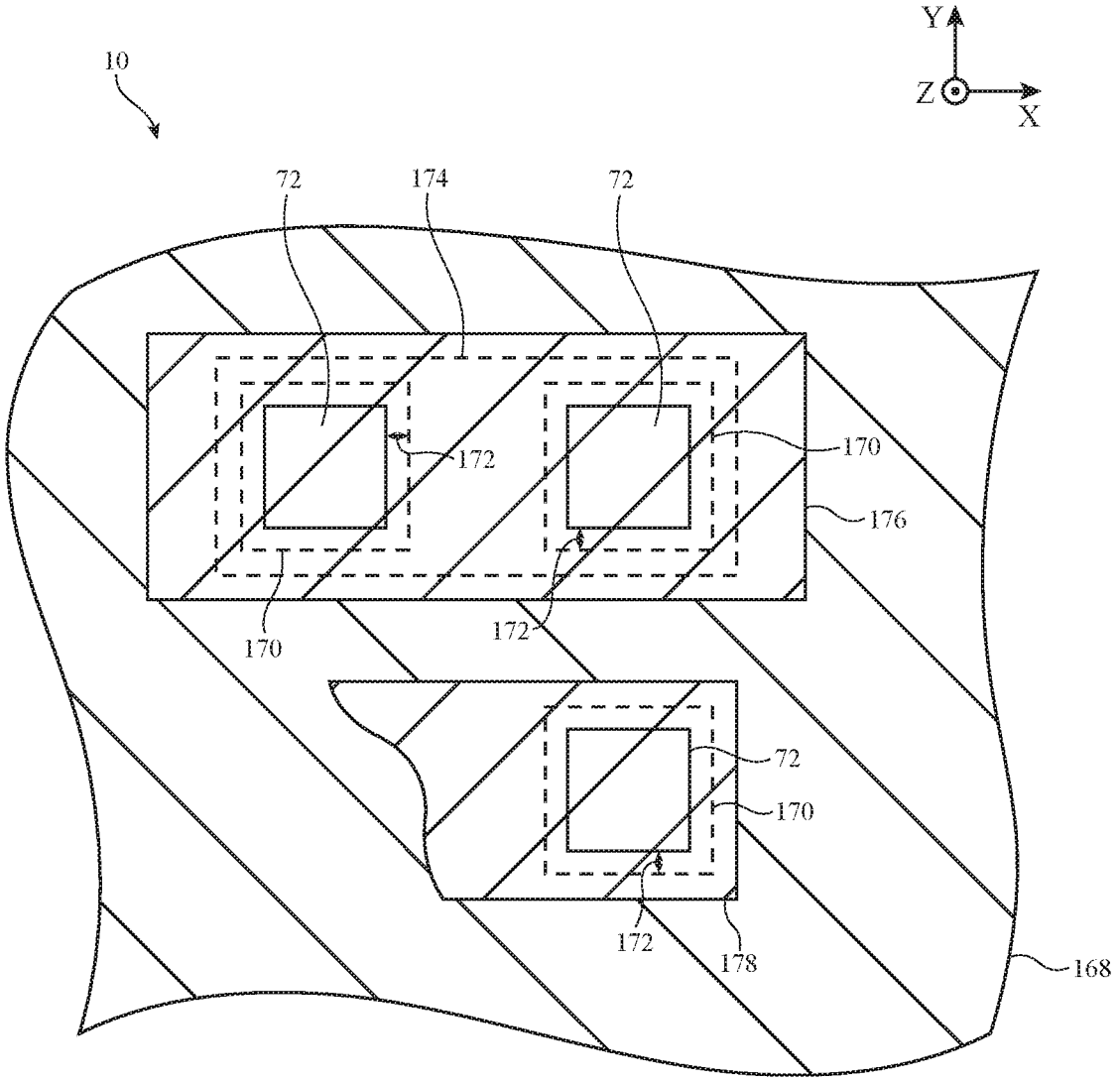
FIGS. 14 and 15 are top views showing how an illustrative conductive shielding layer may be provided over antennas of the types shown in FIGS. 2-13 for mitigating cross-polarization interference in accordance with some embodiments.

FIG. 14 is a top-down view showing how flexible printed circuit 70 of FIG. 7 may be mounted within device 10. As shown in FIG. 14, device 10 may include a conductive layer such as conductive support plate 168. Conductive support plate 168 may form a part of rear housing wall 12R of FIG. 1, may provide mechanical support to device 10, and may extend across some or all of the length and width of device 10. Conductive support plate 168 may be held at a ground potential and may form a part of the antenna ground for the antennas in device 10. A dielectric layer such as dielectric cover layer 114 of FIG. 11 may be layered under conductive support plate 168, if desired (not shown in FIG. 14 for the sake of clarity).

Conductive support plate 168 may have openings such as openings 170 (sometimes referred to herein as slots 170). Stubs 72 of flexible printed circuit 70 (e.g., the portions of flexible printed circuit 70 where regions 80, 78, and 74 of FIG. 7 and thus the antennas are located on the flexible printed circuit) may be aligned with openings 170. Stubs 72 may be inserted within openings 170 or may otherwise overlap openings 170. Each stub 72 may include a corresponding dual-band antenna such as the dual-band antenna shown in FIGS. 10 and 11 or may include a corresponding set of antennas such as set 134 of FIG. 12 (e.g., a triplet of dual-band antennas or a triplet of sets of single band antennas may be aligned with the openings in conductive support plate 168). In another suitable arrangement, two of stubs 72 (e.g., the upper-most stubs 72 shown in FIG. 14) may be aligned with a single opening in conductive support plate 168, as shown by dashed region 174.

In practice, there may be one or more gaps 172 between the antenna structures on each stub 72 and the edges of the opening 170 with which that stub has been aligned. Gaps 172 may be, for example 0.4 mm, 0.2-0.5 mm, 0.1-0.6 mm, or other sizes. The antennas on each stub 72 may be configured to convey radio-frequency signals with a single linear polarization. However, the presence of gaps 172 may introduce cross-polarization interference in which radio-frequency signals of other polarizations are undesirably conveyed by the antennas on stub 72. In order to mitigate this cross-polarization interference, a conductive shielding layer such as conductive shielding layer 176 may be provided over openings 170. If desired, other conductive components 178 (e.g., a battery for device 10 or other components in device 10 having conductive structures) may overlap one or more openings 170 instead of conductive shielding layer 176. In the example of FIG. 14, a single conductive shielding layer 176 has been provided over the upper-most openings 170 in conductive support plate 168 whereas conductive component 178 covers the bottom-most opening 170. Conductive shielding layer 176 and conductive component 178 may prevent radio-frequency signals of other polarizations from interfering with the radio-frequency signals conveyed by the antennas on stubs 72.

Figure 15:
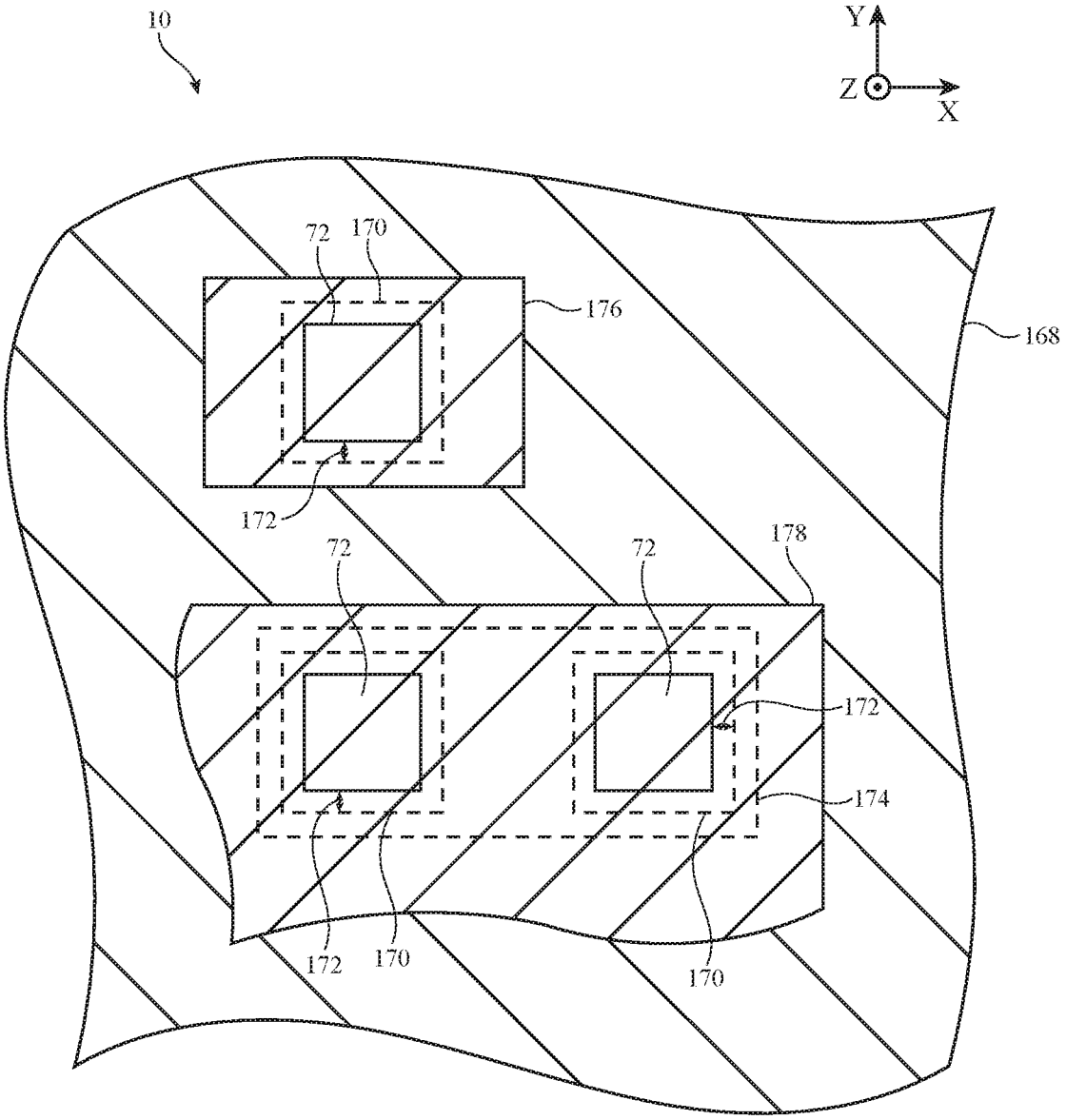

The example of FIG. 14 is merely illustrative. If desired, different conductive shielding layers 176 may be provided over different openings 170. In another suitable arrangement, conductive component 178 may cover two openings 170 whereas conductive shielding layer 176 only covers a single opening 170, as shown in the top-down view of FIG. 15. These examples are merely illustrative and, in general, any desired combination of zero, one, or more than one conductive layer 176 and zero, one, or more than one conductive component 178 may be used to cover any desired openings 170 in conductive support plate 168.

Figure 16:
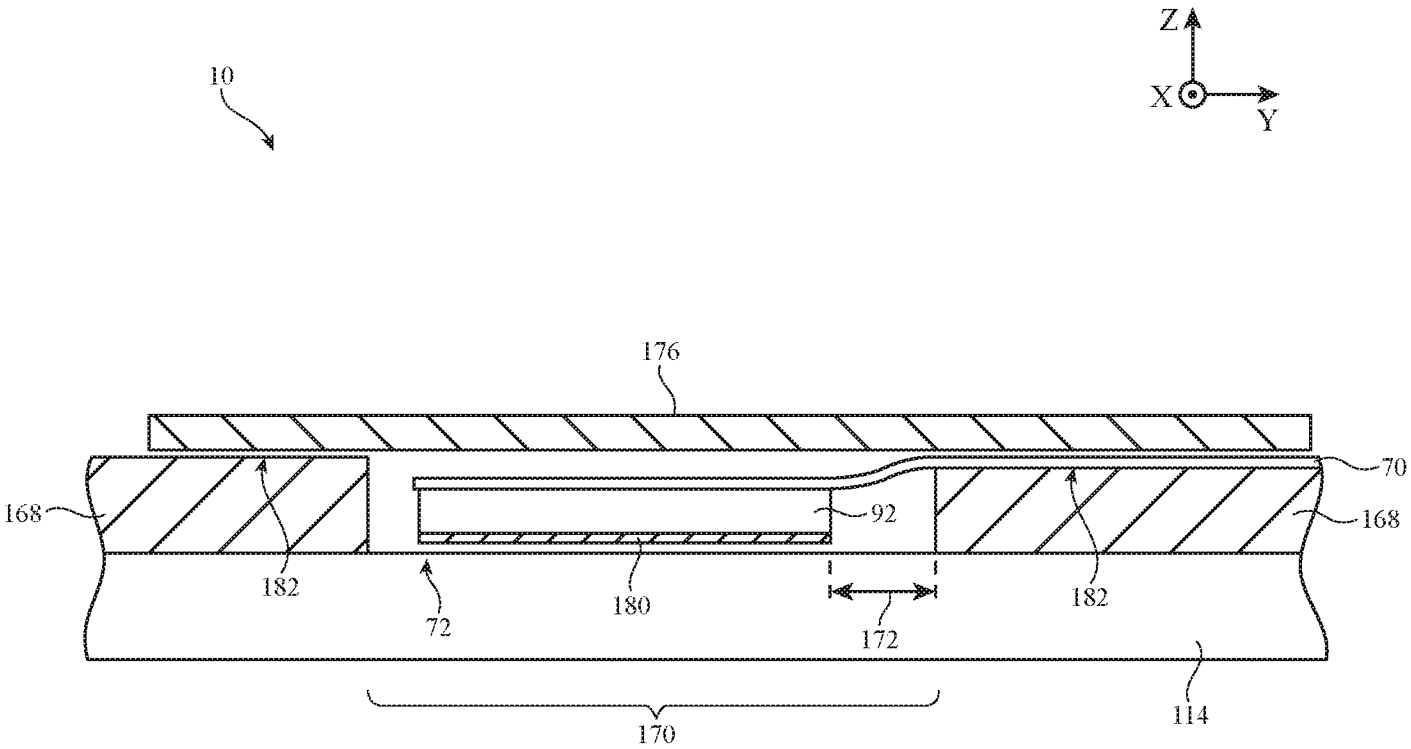
FIG. 16 is a cross-sectional side view showing how an illustrative conductive shielding layer may be provided over antennas of the types shown in FIGS. 2-13 for mitigating cross-polarization interference in accordance with some embodiments.

FIG. 16 is a cross-sectional side view showing how conductive shielding layer 176 may cover a given opening 170 in conductive support plate 168. As shown in FIG. 16, dielectric cover layer 114 may be layered under conductive support plate 168. Flexible printed circuit 70 may extend along conductive support plate 168. Stub 72 of flexible printed circuit 70 may extend within opening 170 in conductive support plate 168. Antenna structures 180 may be formed on flexible printed circuit substrate 92 at stub 72. Antenna structures 180 may include the dual-band antenna of FIGS. 10 and 11 or the set 134 of antennas 40-A, 40-B, 40-C, and 40-D of FIG. 12. Stub 72 (e.g., antenna structures 180) may be located within opening 170 between upper surface 182 of conductive support plate 168 and dielectric cover layer 114.

Conductive shielding layer 176 may be layered over conductive support plate 168 and flexible printed circuit 176. Conductive shielding layer 176 may completely cover opening 170. Conductive shielding layer 176 may be galvanically connected to conductive support plate 168 (e.g., using solder, welds, or other conductive adhesives), may be placed into contact with conductive support plate 168, or may be separated from and capacitively coupled to conductive support plate 168. Conductive shielding layer 176 may include sheet metal, conductive adhesive (e.g., copper tape having an adhesive layer), conductive traces on a dielectric substrate, conductive portions of the housing for device 10, conductive foil, ferrite, or any other desired structures that block radio-frequency signals. In the absence of conductive shielding layer 176, gap 172 may radiate in response to radio-frequency signals from polarizations other than the polarization handled by antenna structures 180. This may introduce undesirable cross-polarization interference on the radio-frequency signals handled by antenna structures 180. The presence of conductive shielding layer 176 may block these radio-frequency signals from causing gap 172 to radiate, thereby mitigating cross-polarization interference for antenna structures 180.

Figure 17:
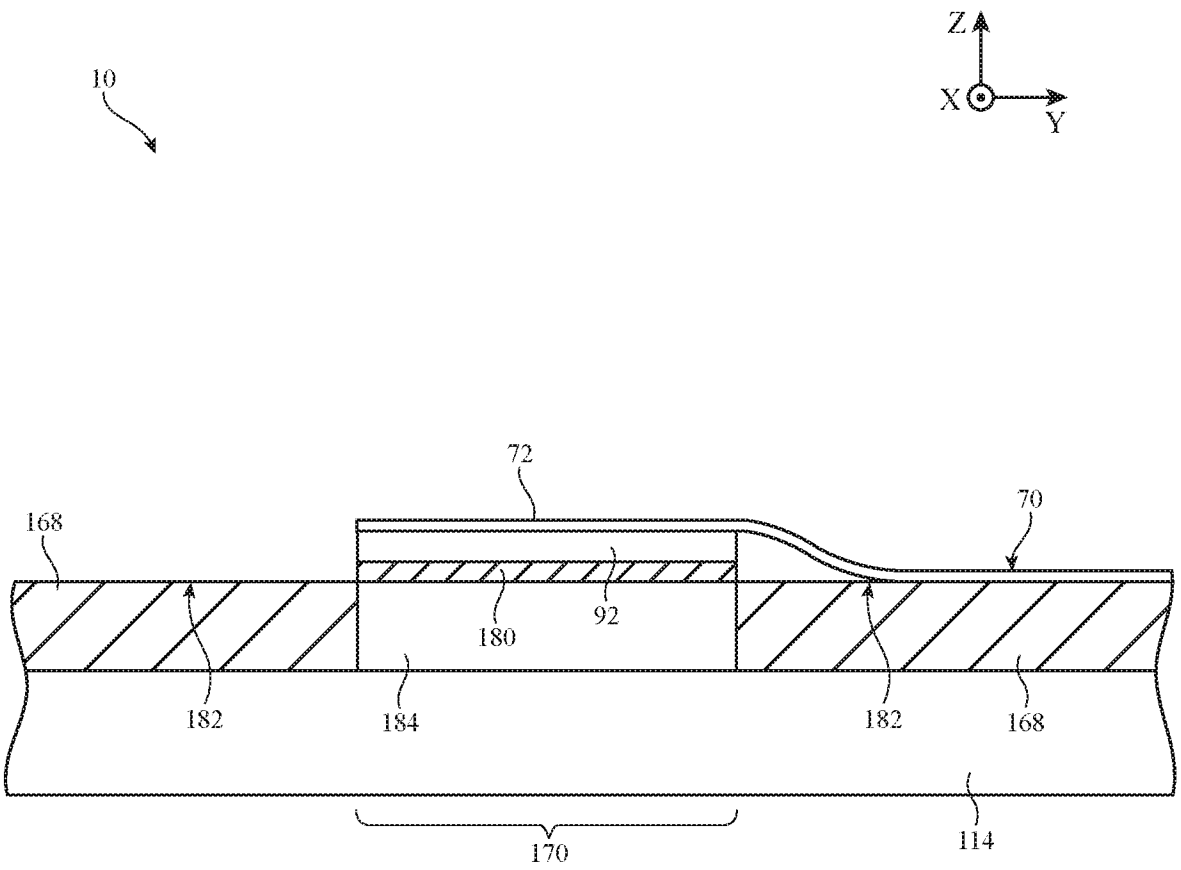
FIG. 17 is a cross-sectional side view showing how antennas of the types shown in FIGS. 2-13 may be arranged over a conductive support plate for mitigating cross-polarization interference without a separate conductive shielding layer in accordance with some embodiments.

The example of FIG. 16 is merely illustrative. If desired, conductive components such as conductive component 178 of FIGS. 14 and 15 may overlap gap 170 to prevent cross-polarization interference. FIG. 17 is a cross-sectional side view showing how flexible printed circuit 70 may be configured to mitigate cross-polarization interference without conductive shielding layer 176. As shown in FIG. 17, a dielectric substrate such as dielectric shim 184 may be placed on dielectric cover layer 114 within opening 170. Dielectric shim 184 may, for example, be formed from plastic or other dielectric materials. The upper surface of dielectric shim 184 may lie flush with upper surface 182 of conductive support plate 168. Stub 72 of flexible printed circuit 70 may be placed on and aligned with dielectric shim 184 in opening 170. Antenna structures 180 may completely fill the lateral area of opening 170 (e.g., the outer perimeter of antennas 40-A, 40-B, 40-C, and 40-D of FIG. 12, the outer perimeter of antenna resonating element 86 of FIG. 10, or grounded shielding ring 98 of FIG. 10 may be equal to the lateral perimeter of plastic shim 184). This may align antenna structures 180 with gap 170 without introducing any gap between the antenna structures and conductive support plate 168. Because no gaps are formed between antenna structures 180 and conductive support plate 168 in this example, no structures exist on stub 72 that radiate in response to radio-frequency signals of other polarizations, and cross-polarization interference is prevented. The presence of plastic shim 184 may prevent antenna structures 180 from undesirably shorting to conductive support plate 168.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a dielectric substrate;

an antenna having first and second resonating element arms formed from conductive traces on the dielectric substrate, a first positive antenna feed terminal coupled to the first resonating element arm, and a second positive antenna feed terminal coupled to the second resonating element arm, wherein the first resonating element arm is configured to radiate in a first ultra-wideband communications band and the second resonating element arm is configured to radiate in a second ultra-wideband communications band that is higher than the first ultra-wideband communications band;

a first radio-frequency transmission line on the dielectric substrate; and a second radio-frequency transmission line on the dielectric substrate, wherein the second radio-frequency transmission line couples the first radio-frequency transmission line to the first and second positive antenna feed terminals and comprises:

a first signal trace segment configured to match an impedance of the first radio-frequency transmission line to an impedance of the first positive antenna feed terminal in the first ultra-wideband communications band, and a second signal trace segment configured to match the impedance of the first radio-frequency transmission line to an impedance of the second positive antenna feed terminal in the second ultra-wideband communication band.

2. The electronic device defined in claim 1, wherein the first signal trace is configured to form an open circuit in the second ultra-wideband communications band and the second signal trace is configured to form an open circuit in the first ultra-wideband communications band.

3. The electronic device defined in claim 1, wherein the first radio-frequency transmission line comprises a signal conductor and the second radio-frequency transmission line comprises a third signal trace segment coupled to the signal conductor, the first and second signal trace segments extending from opposing sides of the third signal trace segment.

4. The electronic device defined in claim 3, wherein the first signal trace segment has a first length extending from the third signal trace segment to the first positive antenna feed terminal and a first width perpendicular to the first length, the second signal trace segment has a second length extending from the third signal trace segment to the second positive antenna feed terminal and a second width perpendicular to the second length, the first length and the first width are configured to match the impedance of the first radio-frequency transmission line to the impedance of the first positive antenna feed terminal in the first ultra-wideband communications band, and the second length and the second width are configured to match the impedance of the first radio-frequency transmission line to the impedance of the second positive antenna feed terminal in the second ultra-wideband communications band.

5. The electronic device defined in claim 3, further comprising:

ground traces on the dielectric substrate; and a fence of conductive vias extending from the conductive traces to the ground traces through the dielectric substrate, wherein the fence of conductive vias separates the first resonating element arm from the second resonating element arm.

6. The electronic device defined in claim 5, wherein the third signal trace segment is aligned with the fence of conductive vias.

7. The electronic device defined in claim 3, wherein the first radio-frequency transmission line comprises a stripline transmission line and the second radio-frequency transmission line comprises a microstrip transmission line.

8. The electronic device defined in claim 3, the dielectric substrate comprising a flexible printed circuit substrate having a plurality of layers, wherein the first, second, and third signal trace segments and the signal conductor are patterned on the same layer of the plurality of layers.

9. The electronic device defined in claim 3, further comprising:

a grounded shielding ring extending around the first and second resonating element arms.

10. The electronic device defined in claim 1, wherein the first ultra-wideband communications band comprises a 6.5 GHz ultra-wideband communications band, the second ultra-wideband communications band comprising an 8.0 GHz ultra-wideband communications band.

11. The electronic device defined in claim 1, further comprising:

a display having a display cover layer that forms a front face of the electronic device;

a dielectric cover layer that forms a rear face of the electronic device;

a conductive support plate overlapping the dielectric cover layer and having an opening, wherein the dielectric substrate and the antenna are mounted within the opening, the antenna being configured to radiate through the dielectric cover layer; and a conductive shielding layer that covers the opening and that is electrically coupled to the conductive support plate.

12. The electronic device defined in claim 1, further comprising:

a dielectric cover layer that forms a face of the electronic device;

a conductive support plate on the dielectric cover layer and having an opening; and a plastic shim on the dielectric cover layer and in the opening, wherein a surface of the plastic shim lies flush with a surface of the conductive support plate, the dielectric substrate is mounted to the surface of the plastic shim, and the antenna extends across the opening.

13. An electronic device having opposing first and second faces, the electronic device comprising:

a display having a display cover layer at the first face;

a housing having peripheral conductive housing structures and a conductive support plate that extends between the peripheral conductive housing structures;

a dielectric cover layer at the second face and layered on the conductive support plate;

first, second, and third openings in the conductive support plate;

a flexible printed circuit substrate;

first, second, and third ultra-wideband antennas on the flexible printed circuit substrate and aligned with the first, second, and third openings, respectively, wherein the first, second, and third ultra-wideband antennas are configured to radiate through the dielectric cover layer; and a conductive shielding layer that covers the first opening and the first ultra-wideband antenna, wherein the conductive shielding layer is electrically coupled to the conductive support plate and is configured to mitigate cross-polarization interference at the first ultra-wideband antenna.

14. The electronic device defined in claim 13, further comprising a battery that covers the second and third openings and the second and third ultra-wideband antennas.

15. The electronic device defined in claim 13, wherein the conductive shielding layer covers the second opening and the second ultra-wideband antenna, the electronic device further comprising a conductive component that covers the third opening and the third ultra-wideband antenna.

16. The electronic device defined in claim 13, further comprising:

a dielectric shim on the dielectric cover layer in the second opening, wherein the second ultra-wideband antenna is mounted to the dielectric shim and extends across the second opening.

* * * * *